US005338654A

United States Patent [19]

Saito et al.

[11] Patent Number: 5,338,654

[45] Date of Patent: Aug. 16, 1994

[54] SILVER HALIDE COLOR PHOTOGRAPHIC MATERIAL

[75] Inventors: Naoki Saito; Takayoshi Kamio; Seiji Ichijima; Keiji Mihayashi, all of Kanagawa, Japan

[73] Assignee: Fuji Photo Film Co., Ltd., Kanagawa, Japan

[21] Appl. No.: 58,924

[22] Filed: May 10, 1993

[30] Foreign Application Priority Data

May 11, 1992 [JP] Japan ..... 4-143669

[51] Int. Cl.[5] ..... G03C 1/08; G03C 7/26; G03C 7/32

[52] U.S. Cl. ..... 430/557; 430/388; 430/389; 430/543

[58] Field of Search ..... 430/388, 389, 557, 502, 430/543

[56] References Cited

U.S. PATENT DOCUMENTS 2,500,487 3/1950 Craig ..... 430/388
4,477,563 10/1984 Ichijima et al. ..... 430/557
4,500,634 2/1985 Sakanow et al. ..... 430/557

FOREIGN PATENT DOCUMENTS 991453 6/1951 France .

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide color photographic material containing at least one coupler compound of the formula (1) in at least one hydrophilic colloid layer which is provided on a support:

$$R^1OCOCHXCONR^2R^3 \quad (1)$$

where $R^1$ represents a branched alkyl group including a cyclic alkyl group and a cyclic alkyl-substituted alkyl group, an aryl group or a heterocyclic group; $R^2$ represents a hydrogen atom, an alkyl group, an aryl group or a heterocyclic group; $R^3$ represents an alkyl group, an aryl group or a heterocyclic group; X represents a group which splits off from the coupler compound when the coupler compound is reacted with an oxidation product of an aromatic primary amine developing agent; and $R^2$ and $R^3$ may be bonded to each other to form a ring. The coupler has a high dye-forming rate to give a dye having a high color density and a high color fastness. The material has improved sharpness and color fastness and an elevated sensitivity.

25 Claims, No Drawings

SILVER HALIDE COLOR PHOTOGRAPHIC MATERIAL

FIELD OF THE INVENTION

The present invention relates to a silver halide color photographic material containing a novel yellow coupler and, more particularly, to a silver halide color photographic material which is processed to form a color image having a high color fastness in the presence of the novel yellow coupler which has a high reactivity. The photographic material gives a color image having improved sharpness, elevated sensitivity and elevated color fastness.

BACKGROUND OF THE INVENTION

A color photographic material is exposed and then color-developed, whereupon an oxidized aromatic primary amine developing agent which is formed in the color developer during the color-development reacts with couplers in the material to give a color image. In the system of forming color images, color reproduction by a subtractive color process is employed, where yellow, magenta and cyan color images are formed for reproduction of blue, green and red, the former being complementary to the latter, respectively.

Couplers not only must form dyes, but also the dyes to be formed by the couplers should have an excellent spectral absorption characteristic, the dyes should have a high color density, the couplers should have a high dye-forming speed, and the dyes to be formed by them should have high fastness to light, heat and moisture. In particular, since photographic materials are desired to have high sensitivity and to provide a high-quality image, development of couplers having a high color image-forming rate and giving high-density color images is strongly desired.

In planning DIR couplers, which are couplers which release a development inhibitor when reacted with an oxidation product of an aromatic primary amine developing agent and which are used for the purpose of improving the sharpness and color reproducibility of photographic images, the above-mentioned properties are extremely important factors.

Regarding planning of coupler skeletons of yellow couplers for the purpose of elevating their color image-forming rate, British Patent 1,204,680, U.S. Pat. No. 4,149,886 and JP-A-57-151944 (the term "JP-A" as used herein means an "unexamined published Japanese patent application") proposed a malondianilide skeleton and French Patent 991,453 and U.S. Pat. No. 2,500,487 proposed an alkoxyacetanilide skeleton. However, since all the proposed couplers have a poor color image fastness, they could not be put to practical use as a photographic color image-forming coupler. Since the alkoxyacetanilide couplers give a color image having a better color hue and a higher color image fastness than the malondianilide couplers, novel molecular planning of such alkoxyacetanilide couplers would be desirable so as to elevate them to a practical level.

SUMMARY OF THE INVENTION

An object of the present invention is to provide a silver halide color photographic material which contains a yellow coupler having an elevated dye-forming rate to give a color image having an elevated color density and an elevated color fastness, the material therefore having an elevated high sensitivity to give a color image having an elevated sharpness and an elevated color fastness.

To achieve the foregoing and other objects, the present invention provides a silver halide color photographic material having at least one coupler compound of the following general formula (1) in at least one hydrophilic colloid layer provided on a support:

$$R^1OCOCHXCONR^2R^3 \quad (1)$$

where $R^1$ represents a branched alkyl group including a cyclic alkyl group and a cyclic alkyl-subsituted alkyl group, an aryl group or a heterocyclic group; $R^2$ represents a hydrogen atom, an alkyl group, an aryl group or a heterocyclic group; $R^3$ represents an alkyl group, an aryl group or a heterocyclic group; X represents a group which splits off from the coupler compound when the coupler compound is reacted with an oxidation product of an aromatic primary amine developing agent; and $R^2$ and $R^3$ may be bonded to each other to form a ring.

DETAILED DESCRIPTION OF THE INVENTION

Compounds of formula (1) for use in the present invention are described below in detail.

In formula (1), the branched alkyl group including a cyclic alkyl group and a cyclic alkyl-subsituted alkyl group of $R^1$ has from 3 to 30, preferably from 3 to 22, carbon atoms including the branch(es). The position of the branch of the branched alkyl group can be at any location, but is preferably on the carbon atom which is bonded to the oxygen atom of formula (1). For instance, the branched alkyl group including a cyclic alkyl-substituted alkyl group includes isopropyl, t-butyl, t-amyl, cyclohexyl, 2-ethylhexyl, sec-butyl, isobutyl, isoamyl, t-octyl, cyclohexyl, 4-t-butyl cyclohexyl, cyclohexylmethyl and neopentyl groups, which may optionally be substituted.

In formula (t), when $R^2$ and $R^3$ represent an alkyl group, the alkyl group has from 1 to 30, preferably from 1 to 22, carbon atoms and may be either linear or branched and either acyclic or cyclic. For instance, examples of alkyl groups represented by $R^2$ and $R^3$ include methyl, ethyl, propyl, isopropyl, isoamyl, 2-ethylhexyl, dodecyl and cyclohexyl groups, which may optionally be substituted.

In formula (1), when $R^1$, $R^2$ and $R^3$ represent an aryl group, the aryl group has from 6 to 20, preferably from 6 to 10, especially preferably 6, carbon atoms, and includes, for example, phenyl, naphthyl and anthracenyl groups, which may optionally be substituted.

In formula (1), when $R^1$, $R^2$ and $R^3$ represent a heterocyclic group, the heterocyclic group is preferably a 5-membered to 7-membered heterocyclic group, which preferably has at least one hetero atom selected from nitrogen, oxygen and sulfur atoms and has from 1 to 10 carbon atoms. For instance, examples of heterocyclic groups represented by $R^1$, $R^2$ and $R^3$ include 2-furyl, 2-thienyl, 2-pyridyl, 2-imidazolyl, 2-(1,3-oxazolyl), 5-tetrazolyl, 1-piperidinyl, 5-indolinyl, 1,3,4-thiadiazolyl, benzoxazol-2-yl, benzothiazol-2-yl, benzimidazol-2-yl, 1,2,4-triazol-5-yl, 3-pyrazolyl, 2-morpholyl, 4-morpholyl, 2-quinolyl and 2-quinazolyl groups, which may optionally be substituted.

In formula (1), X is a group capable of splitting off from the coupler compound when the coupler compound is reacted with an oxidation product of an aromatic primary amine developing agent. X is preferably an aryloxy group (e.g., phenoxy, naphthoxy), a heterocyclic-oxy group, an arylthio group, a heterocyclic-thio group, an imido group which is bonded to the coupling position of the coupler compound via the nitrogen atom of the group (e.g., 2,4-dioxo-1,3-imidazolidin-3-yl, 2,4-dioxo-1,3-oxazolidin-3-yl, 3,5-dioxo-1,2,4-triazolidin-4-yl, succinimido, phthalimido, 2,4-dioxo-1,3-imidazolidin-1-yl), or an unsaturated nitrogen-containing heterocyclic group which is bonded to the coupling position of the coupler compound via the nitrogen atom of the group (e.g., 1-imidazolyl, 1-pyrazolyl, 1,2,4-triazol-1 (or 4)-yl, 1,2,3-triazol-1-yl, benzotriazol-1-yl, 3-pyrazolin-5-on-1-yl).

The split-off group may be any non-photographically useful group or photographically useful group and their precursors (for example, groups which function as development inhibitors, development accelerators, desilvering accelerators, foggants, dyes, hardening agents, couplers, scavengers for oxidation products of developing agents, fluorescent dyes, developing agents or electron transfer agents).

Where X is a photographically useful group, it may be any of the known ones described, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, 4,741,994, European Patent Laid-Open Nos. 193,389A, 348,139A and 272,573A. Of the photographically useful groups, especially preferred for use in the present invention are those which function as development inhibitors, electron transfer agents, desilvering accelerators (bleaching accelerators) or dyes.

When $R^1$, $R^2$, $R^3$ and X in formula (1) each independently is a branched alkyl including a cyclic alkyl group and a cyclic alkyl-substituted alkyl group, an alkyl, aryl or heterocyclic group, they may optionally have substituent(s). Examples of the substituents include a halogen atom (e.g., fluorine, chlorine), an alkoxycarbonyl group (having from 2 to 30, preferably from 2 to 20, carbon atoms, such as methoxycarbonyl, dodecyloxycarbonyl, hexadecyloxycarbonyl), an acylamino group (having from 2 to 30, preferably from 2 to 20, carbon atoms, such as acetamido, tetradecanamido, 2-(2,4-di-t-amylphenoxy)-butanamido, benzamido), a sulfonamido group (having from 1 to 30, preferably from 1 to 20, carbon atoms, such as methanesulfonamido, dodecansulfonamido, hexadecansulfonamido, benzenesulfonamido), a carbamoyl group (having from 1 to 30, preferably from 1 to 20, carbon atoms, such as N-butylcarbamoyl, N,N-diethyl-carbamoyl, N-methylcarbamoyl), a sulfamoyl group (having from 0 to 30, preferably from 0 to 20, carbon atoms, such as N-butylsulfamoyl, N-dodecylsulfamoyl, N-hexadecylsulfamoyl, N-3-(2,4-di-t-amylphenoxy)butylsulfamoyl, N,N-diethylsulfamoyl), an alkoxy group (having from 1 to 30, preferably from 1 to 20, carbon atoms, such as methoxy, hexadecyloxy, isopropoxy), an aryloxy group (having from 6 to 20, preferably from 6 to 10, carbon atoms, such as phenoxy, 4-methoxyphenoxy, 3-t-butyl-4-hydroxyphenoxy, naphthoxy), an aryloxycarbonyl group (having from 7 to 21, preferably from 7 to 11, carbon atoms, such as phenoxycarbonyl), an N-acylsulfamoyl group (having from 2 to 30, preferably from 2 to 20, carbon atoms, such as N-propanoylsulfamoyl, N-tetradecanoylsulfamoyl, N-benzoylsulfamoyl), a sulfonyl group (having from 1 to 30, preferably from 1 to 20, carbon atoms, such as methanesulfonyl, octanesulfonyl, benzenesulfonyl, dodecanesulfonyl), an alkoxycarbonylamino group (having from 1 to 30, preferably from 1 to 20, carbon atoms, such as ethoxycarbonylamino, tetradecyloxycarbonylamino), a cyano group, a nitro group, a carboxyl group, a hydroxyl group, a sulfo group, an alkylthio group (having from 1 to 30, preferably from 1 to 20, carbon atoms, such as methylthio, dodecylthio, dodecylcarbamoylmethylthio), an ureido group (having from 1 to 30, preferably from 1 to 20, carbon atoms, such as N-phenylureido, N-hexadecylureido), an aryl group (having from 6 to 20, preferably from 6 to 10, carbon atoms, such as phenyl, naphthyl, 4-methoxyphenyl), a heterocyclic group (for example, a 3-membered to 12-membered, preferably 5-membered or 6-membered, mono-cyclic ring or condensed ring having from 1 to 20, preferably from 1 to 10, carbon atoms and having at least one hetero atom selected from, for example, a nitrogen atom, an oxygen atom and a sulfur atom; such as 2-pyridyl, 4-pyridyl, 4-pyrimidinyl, 3-pyrazolyl, 1-pyrrolyl, 2,4-dioxo-1,3-imidazolidin-1-yl, morpholino, indolyl), an alkyl group (for example, a linear, branched or cyclic and saturated or unsaturated alkyl group having from 1 to 30, preferably from 1 to 20, carbon atoms; such as methyl, ethyl, isopropyl, cyclopropyl, t-pentyl, t-octyl, cyclopentyl, t-butyl, s-butyl, dodecyl, 2-hexyldecyl), an acyl group (having from 1 to 30, preferably from 2 to 20, carbon atoms, such as acetyl, benzoyl), an arylthio group (having from 6 to 20, preferably from 6 to 10, carbon atoms, such as phenylthio, naphthylthio), a sulfamoylamino group (having from 0 to 30, preferably from 0 to 20, carbon atoms, such as N-butylsulfamoylamino, N-dodecylsulfamoylamino, N-phenylsulfamoylamino), and an N-sulfonylsulfamoyl group (having from 1 to 30, preferably from 1 to 20, carbon atoms, such as N-mesylsulfamoyl, N-ethanesulfonyl-sulfamoyl, N-dodecanesulfonylsulfamoyl, N-hexadecanesulfonylsulfamoyl). The substituents may further be substituted by one or more substituents, such as those mentioned above.

Couplers of formula (1) may be a polymer in the form of a dimer or a higher polymer, such as telomer or polymer, in which two or more molecules of the formula are bonded to each other at the group of X, $R^1$, $R^2$ and/or $R^3$ via a divalent or poly-valent group therebetween. In this case, the previously defined range of the number of the carbon atoms constituting the respective groups does not apply to the dimers or higher telomers or polymers.

The preferred groups for the compounds of formula (1) are mentioned below.

$R^1$ is preferably a branched alkyl group including a cyclic alkyl group and a cyclic alkyl-substititued alkyl group or an aryl group. It is especially preferably an α-branched alkyl group or a phenyl group having a substituent at the ortho-position.

$R^2$ is preferably a hydrogen atom.

$R^3$ is preferably an aryl group, especially preferably a phenyl or naphthyl group. When it is a phenyl group, it preferably has a halogen atom or an alkoxy group at the ortho-position.

X is preferably a nitrogen-containing heterocyclic group. It is especially preferably a 5-membered cyclic imido group which is bonded to the coupling position of the compound via the nitrogen atom of the group, a 1-pyrazolyl group, a 1-imidazolyl group, a 1,2,4-triazolyl group which is bonded to the coupling position of the compound via the 1- or 4-position of the group, a 1-benzotriazolyl group, or a 1,2,3-triazolyl group.

Couplers of formula (1) are preferably non-diffusive couplers. Non-diffusive couplers are those having group(s) therein capable of sufficiently enlarging the molecular weight of the molecule in order that the coupler molecules may be well passivated in the layer to which they have been added. In general, couplers having, as non-diffusive group(s), alkyl group(s) with a total carbon number of from 8 to 30, preferably from 10 to 20, and/or substituted aryl group(s) with a total carbon number of from 4 to 20 are used. Such non-diffusive group(s) may be at any position(s) of the coupler molecule. Plural non-diffusive groups may be therein.

Next, specific examples of couplers of formula (1) for use in the present invention are mentioned below, which, however, are not limitative.

(1)

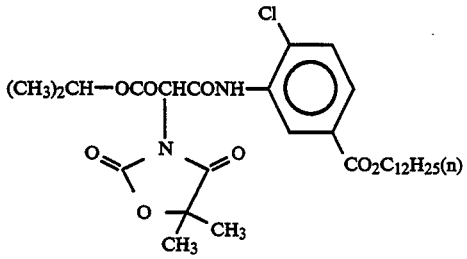

(2)

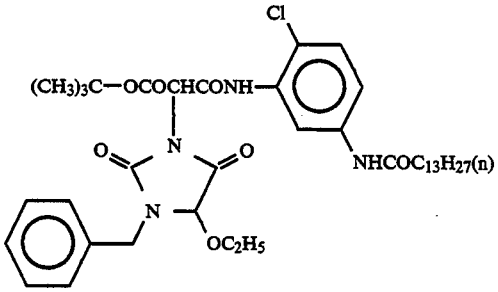

(3)

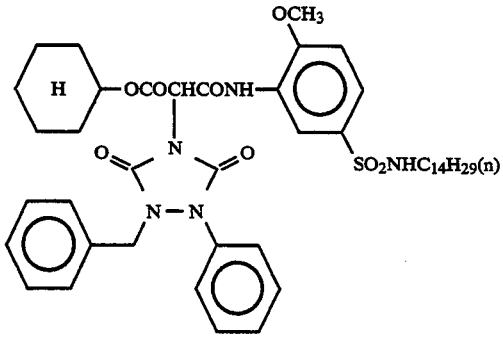

(4)

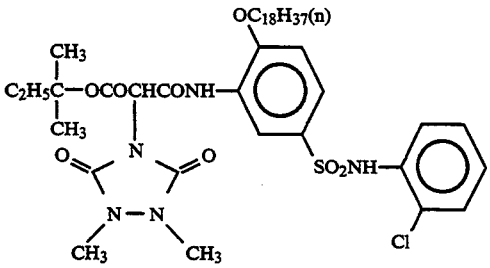

(5)

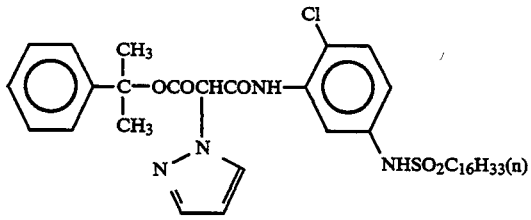

-continued
(6)
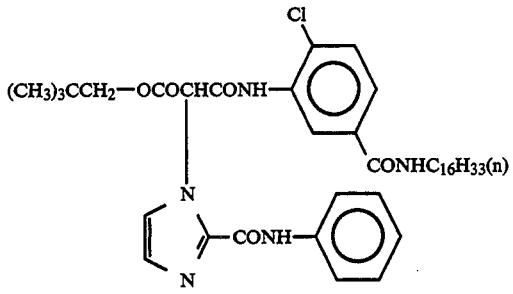
(7)
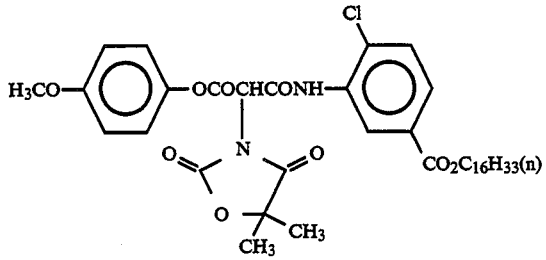
(8)
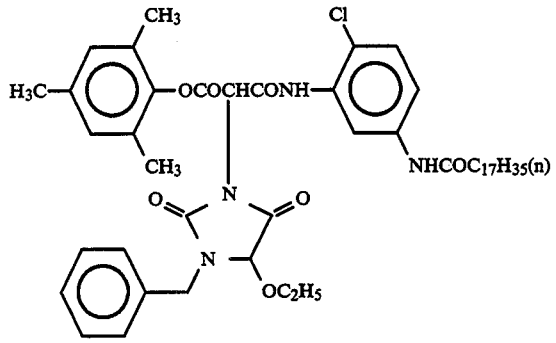
(9)
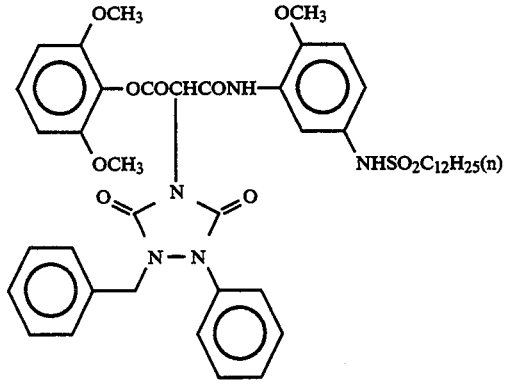
(10)
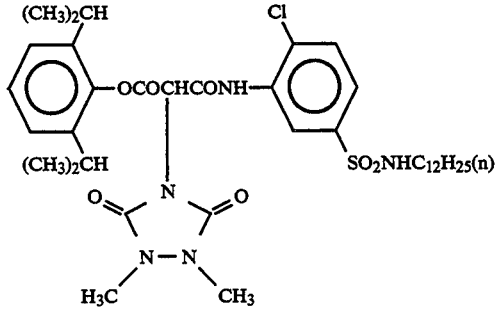

-continued
(11)
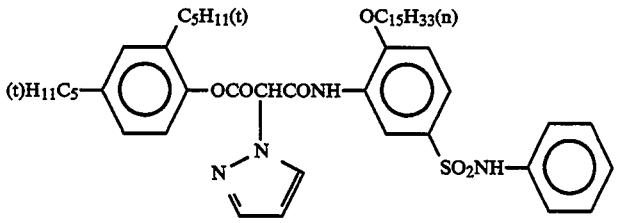
(12)
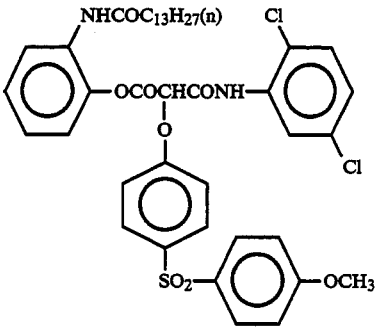
(13)
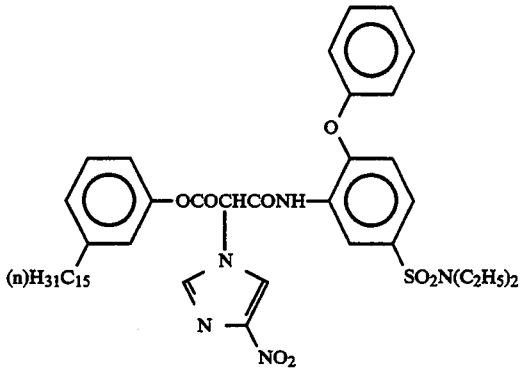
(14)
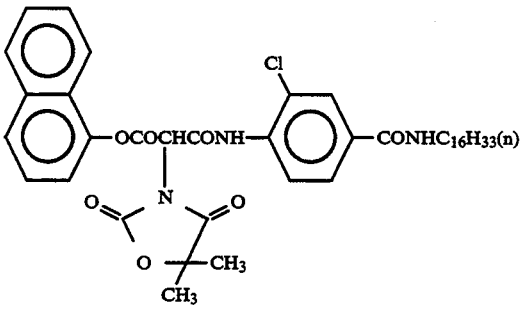
(15)
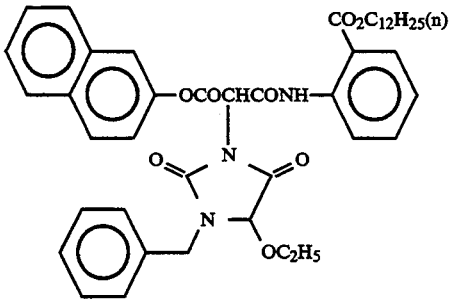

-continued
(16)
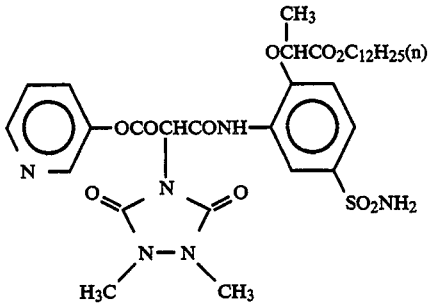
(17)
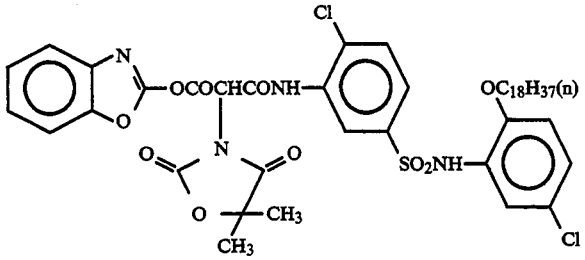
(18)
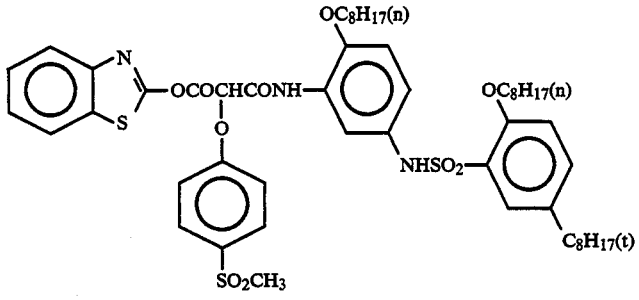
(19)
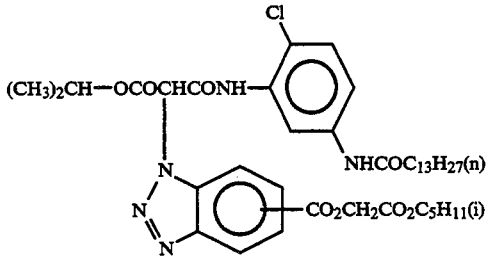
(20)
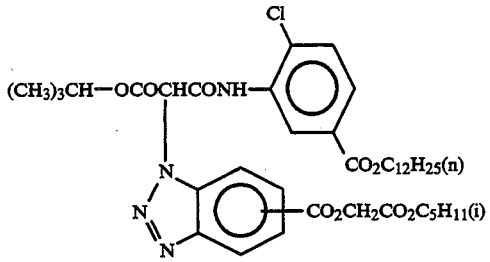
(21)
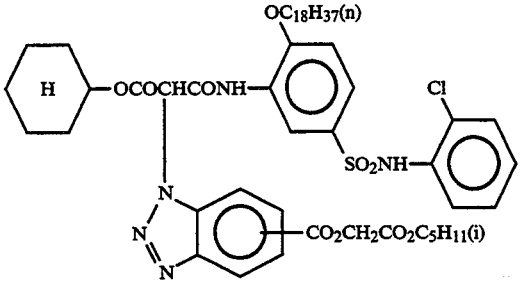

-continued
(22)
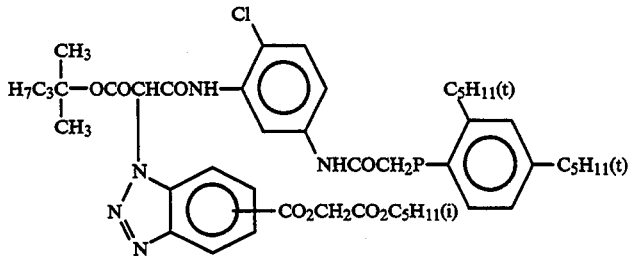
(23)
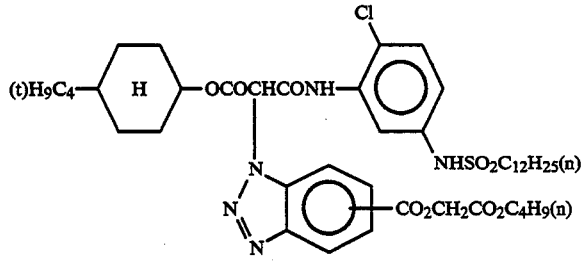
(24)
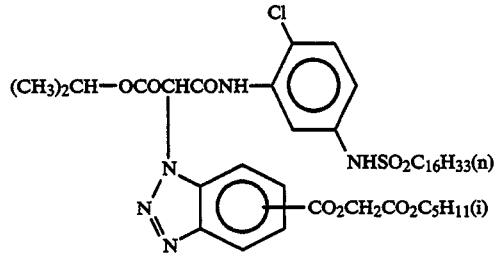
(25)
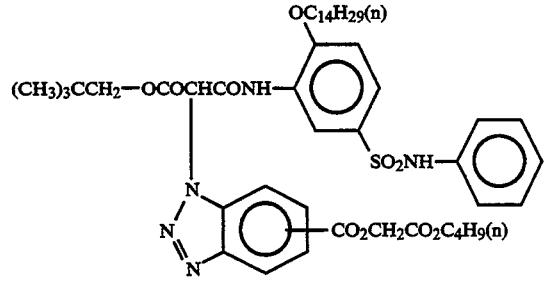
(26)
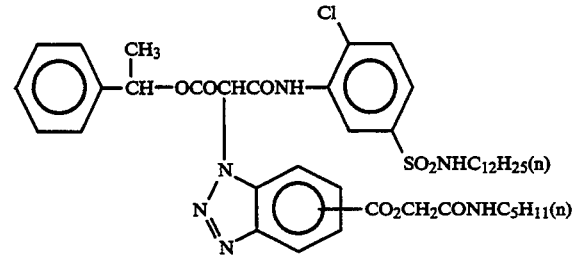
(27)
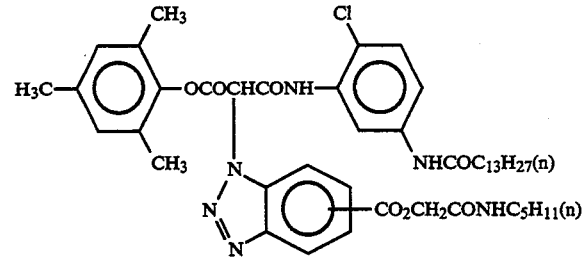

-continued
(28)
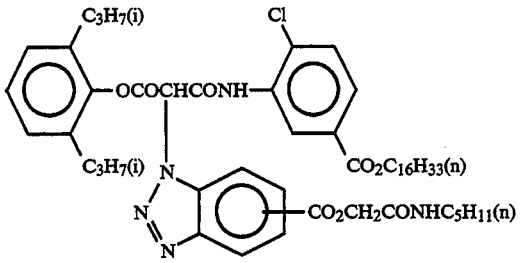
(29)
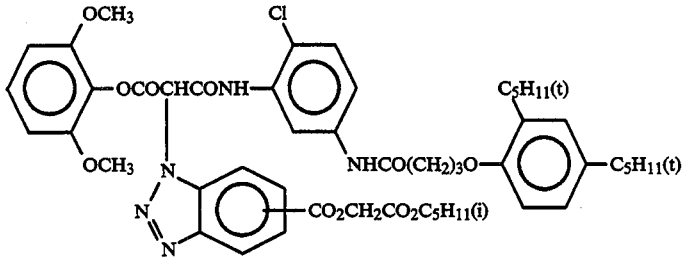
(30)
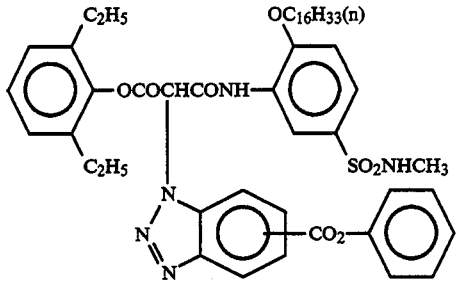
(31)
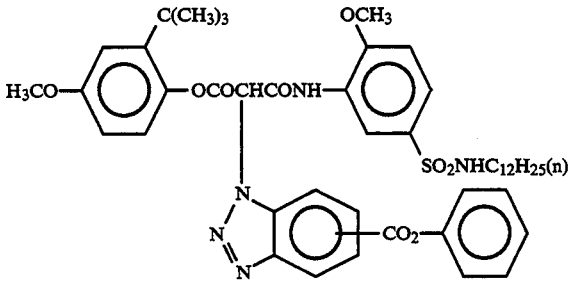
(32)
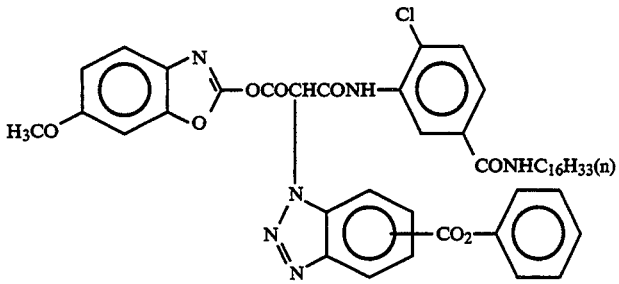
(33)
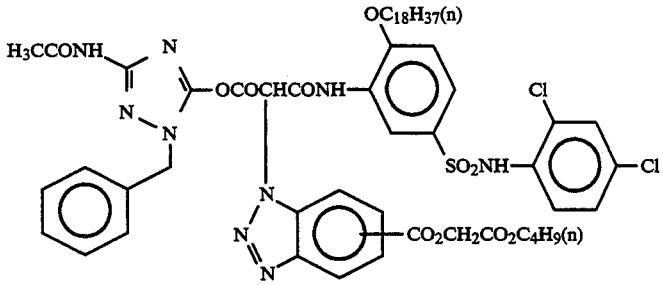

-continued
(34)
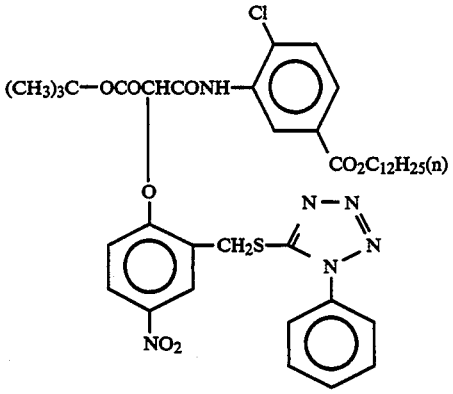
(35)
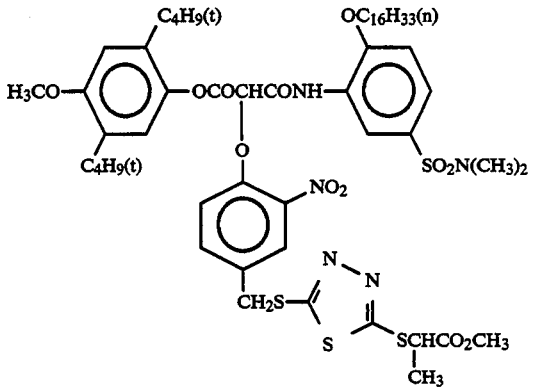
(36)
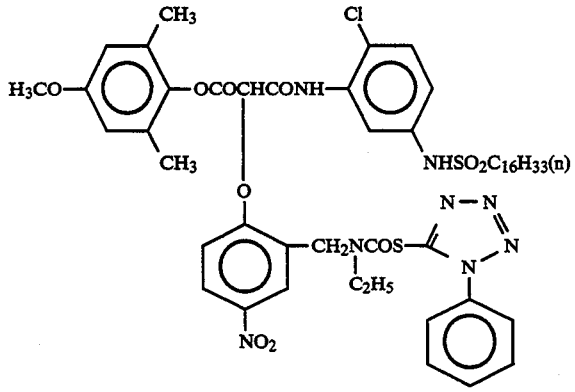
(37)
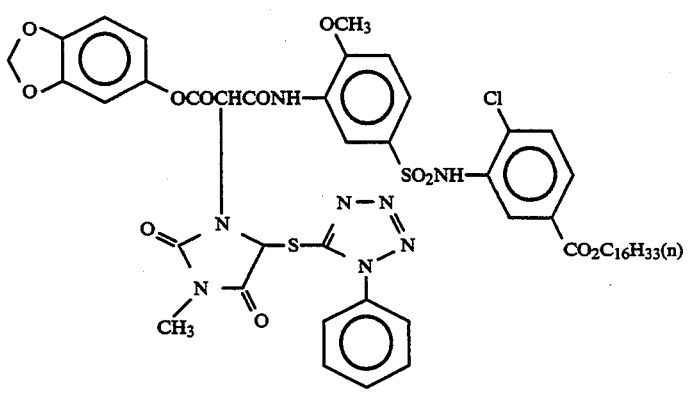

-continued (38)

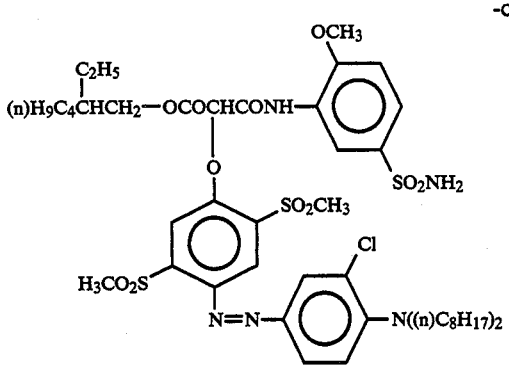

Couplers of formula (1) may be produced with ease by reacting a compound of the following general formula (2) or (3) and XH (where $R^1$, $R^2$, $R^3$ and X have the same meaning as in formula (1)) in the presence of a base.

$R^1OCOCH(Br)CONR^2R^3$ (2)

$R^1OCOCH(Cl)CONR^2R^3$ (3)

Examples for producing typical compounds of formula (1) are mentioned below. Other compounds of formula (1) not illustrated hereunder may also be produced analogously.

SYNTHESIS EXAMPLE 1

Production of Compound (1)

Compound (1 ) was produced in accordance with the reaction route set forth below.

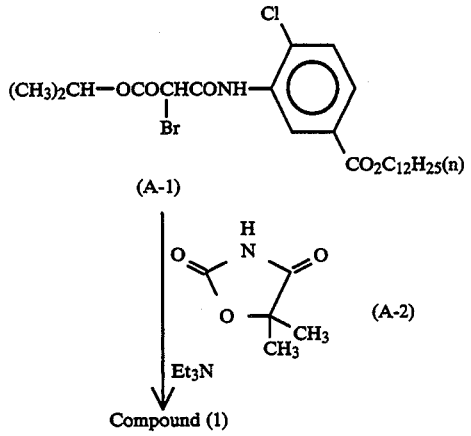

20.0 g of compound (A-1) and 8.42 g of compound (A-2) were mixed along with 100 ml of N,N-dimethylacetamide and stirred at room temperature. 11.1 g of triethylamine was dropwise added thereto over a period of 20 minutes and the resulting reaction mixture was stirred further for one hour. The reaction mixture was poured into water and extracted with ethyl acetate. The organic phase was washed with water, a 5% aqueous sodium carbonate solution and then a diluted hydrochloric acid, in order, and then dried with magnesium sulfate as a desiccant. The desiccant was removed by filtration and the solvent was removed by distillation. Then, an yellow oily product was obtained. The oily product was purified by silica gel chromatography to obtain 16.0 g of compound (1) as a pale yellow oil.

SYNTHESIS EXAMPLE 2

Production of Compound (4)

Compound (4) was produced in accordance with the reaction route set forth below.

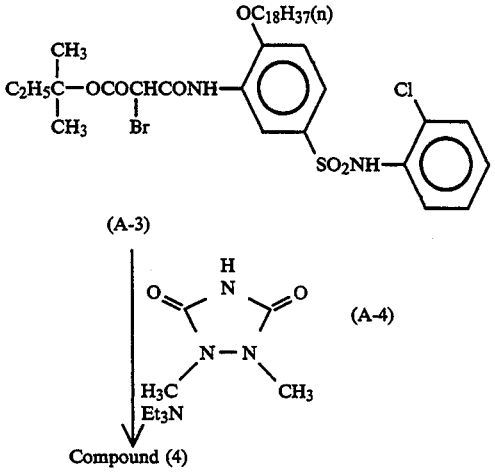

25.0 g of compound (A-3) and 8.21 g of compound (A-4) were mixed along with 150 ml of N,N-dimethylacetamide and stirred at room temperature. 9.65 g of triethylamine was dropwise added thereto over a period of 15 minutes and the resulting reaction mixture was stirred further for one hour. The reaction mixture was poured into water and extracted with ethyl acetate. The organic phase was washed with water, a 5% aqueous sodium carbonate solution and then a diluted hydrochloric acid, in order, and then dried with magnesium sulfate as a desiccant. The desiccant was removed by filtration and the solvent was removed by distillation. Then, an yellow oily product was obtained. This product was purified by silica gel chromatography to obtain 21.8 g of compound (4) as a colorless oil.

SYNTHESIS EXAMPLE 3

Production of Compound (9)

Compound (9) was produced in accordance with the reaction route set forth below.

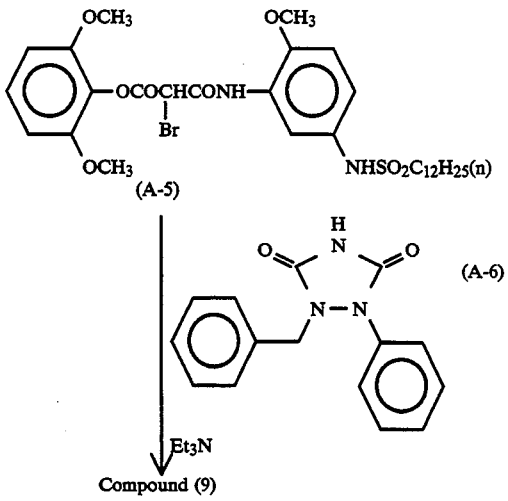

20.0 g of compound (A-5) and 16.5 g of compound (A-6) were mixed along with 100 ml of N,N-dimethylacetamide and stirred at room temperature. 9.35 g of triethylamine was dropwise added thereto over a period of 15 minutes and the resulting reaction mixture was stirred further for one hour. The reaction mixture was poured into water and extracted with ethyl acetate. The organic phase was washed with water, a 5% aqueous sodium carbonate solution and then a diluted hydrochloric acid, in order, and then dried with magnesium sulfate as a desiccant. The desiccant was removed by filtration and the solvent was removed by distillation. Then, an yellow oily product was obtained. This product was purified by silica gel chromatography to obtain 19.3 g of compound (9) as a colorless vitreous solid.

SYNTHESIS EXAMPLE 4

Production of Compound (20)

Compound (20) was produced in accordance with the reaction route set forth below.

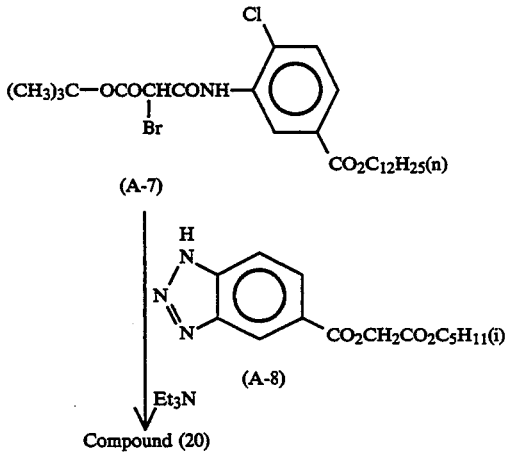

50.0 g of compound (A-7) and 38.1 g of compound (A-8) were mixed along with 300 ml of N,N-dimethylacetamide and stirred at room temperature. 17.6 g of triethylamine was dropwise added thereto over a period of 30 minutes and the resulting reaction mixture was stirred further for 2 hours. The reaction mixture was poured into water and extracted with ethyl acetate. The organic phase was washed with water, a 5% aqueous sodium carbonate solution and then a diluted hydrochloric acid, in order, and then dried with magnesium sulfate as a desiccant. The desiccant was removed by filtration and the solvent was removed by distillation. Then, an yellow oily product was obtained. This product was purified by silica gel chromatography to obtain 53.3 g of compound (20) as a pale yellow oil.

SYNTHESIS EXAMPLE 5

Production of Compound (21)

Compound (21) was produced in accordance with the reaction route set forth below.

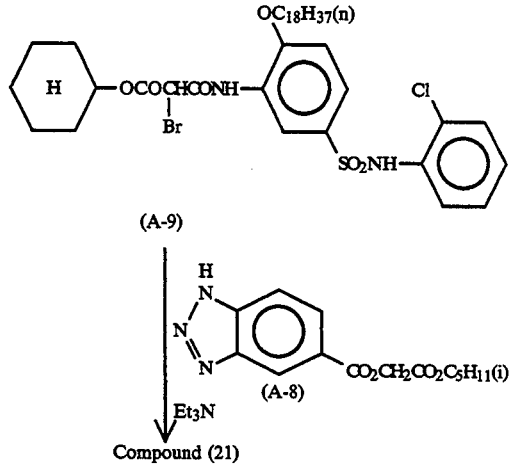

25.0 g of compound (A-9) and 13.7 g of compound (A-8) were mixed along with 150 ml of N,N-dimethylacetamide and stirred at room temperature. 6.33 g of triethylamine was dropwise added thereto over a period of 15 minutes and the resulting reaction mixture was stirred further for one hour. The reaction mixture was poured into water and extracted with ethyl acetate. The organic phase was washed with water, a 5% aqueous sodium carbonate solution and then a diluted hydrochloric acid, in order, and then dried with magnesium sulfate as a desiccant. The desiccant was removed by filtration and the solvent was removed by distillation. Then, an yellow oily product was obtained. This product was purified by silica gel chromatography to obtain 22.5 g of compound (21) as a colorless vitreous solid.

SYNTHESIS EXAMPLE 6

Production of Compound (27)

Compound (27) was produced in accordance with the reaction route set forth below.

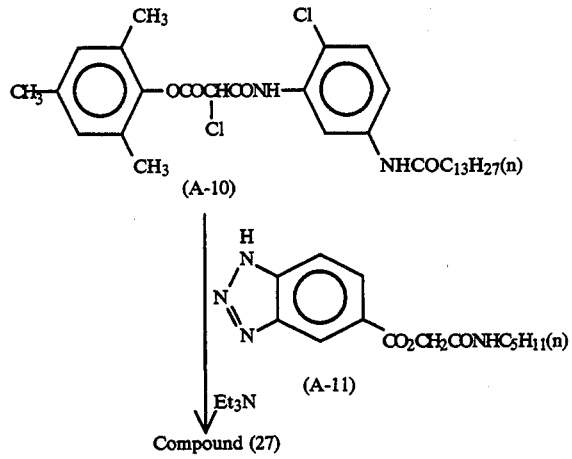

30.0 g of compound (A-10) and 22.1 g of compound (A-11) were mixed along with 200 ml of N,N-dimethylacetamide and stirred at room temperature. 10.3 g of triethylamine was dropwise added thereto over a period of 40 minutes and the resulting reaction mixture was stirred further for 3 hours. The reaction mixture was poured into water and extracted with ethyl acetate. The organic phase was washed with water, a 5% aqueous sodium carbonate solution and then a diluted hydrochloric acid, in order, and then dried with magnesium sulfate as a desiccant. The desiccant was removed by filtration and the solvent was removed by distillation. Then, an yellow oily product was obtained. This was purified by silica gel chromatography to obtain 32.1 g of compound (27) as a pale yellow vitreous solid.

Yellow couplers of formula (1) of the present invention preferably are incorporated into a light-sensitive silver halide emulsion layer or adjacent layers which constitute the photographic material of the present invention. Especially preferably, they are incorporated into a light-sensitive silver halide emulsion layer of the material. The total amount of the yellow couplers of formula (I) which is incorporated into the photographic material is from 0.0001 to 0.80 g/m$^2$, preferably from 0.0005 to 0.50 g/m$^2$, more preferably from 0.02 to 0.30 g/m$^2$, if the split-off group X of the coupler molecule contains a photographically useful group. If the group X does not contain a photographically useful group, the amount of yellow coupler of formula (I) which is incorporated into the photographic material can be from 0.001 to 1.20 g/m$^2$, preferably from 0.01 to 1.00 g/m$^2$, more preferably from 0.10 to 0.80 g/m$^2$.

Yellow couplers of formula (1) of the present invention preferably have a photographically useful group as the split-off group X.

Yellow couplers of formula (1) may be added to the layer(s) which constitutes the photographic material of the present invention in the same manner as that for adding ordinary couplers, as described below.

The photographic material of the present invention generally can be of any type, provided that it has at least one blue-sensitive silver halide emulsion layer, at least one green-sensitive silver halide emulsion layer and at least one red-sensitive silver halide emulsion layer on a support. In the material, the number of the silver halide emulsion layers and non-light-sensitive layers as well as the order of the layers on the support are not particularly limited. As one typical example, there is mentioned a silver halide color photographic material having plural light-sensitive layer units each composed of plural silver halide emulsion layers each having substantially the same color-sensitivity but having a different degree of sensitivity to light of the same wavelength (sensitivity degree). The respective light-sensitive layers are unit light-sensitive layers each having a color-sensitivity to anyone of blue light, green light and red light. In such a multi-layer silver halide color photographic material, in general, the order of the light-sensitive layer units on the support comprises a red-sensitive layer unit, a green-sensitive layer unit and a blue-sensitive layer unit from the side of the support in this order. As the case may be, however, the order may be opposite to the above-mentioned one, in accordance with the object of the photographic material. As still another embodiment of the present invention, a different color-sensitive layer may be sandwiched between two other layers having the same color-sensitivity.

Various non-light-sensitive layers such as an interlayer may be provided between the above-mentioned silver halide light-sensitive layers, as the uppermost layer or lowermost layer.

Such an interlayer may contain various couplers and DIR compounds described in JP-A-61-43748, JP-A-59-113438, JP-A-59-113440, JP-A-61-20037 and JP-A-61-20038, and it may also contain conventional color mixing preventing agents.

As the constitution of the plural silver halide emulsions which constitute the respective light-sensitive layer units, preferred is a two-layered constitution composed of a high-sensitivity emulsion layer and a low-sensitivity emulsion layer such as described in German Patent 1,121,470 and British Patent 923,045. In general, it is preferred that the plural light-sensitive layers are arranged on the support in such a way that the sensitivity degree of the layer gradually decreases in the direction to the support. In this embodiment of the present invention, a non-light-sensitive layer may be provided between the plural silver halide emulsion layers. As another embodiment of the present invention, a low-sensitivity emulsion layer is formed remote from the support and a high-sensitivity emulsion layer is formed near to the support, such as described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; or an order of BH/BL/GL/GH/RH/RL; or an order of BH/BL/GH/GL/RL/RH.

As other examples, there are mentioned an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and JP-A-62-63936.

As a further example, there is mentioned a three-layer unit constitution such as described in JP-B-49-15495, where the uppermost layer is the highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of this type, the sensitivity degree of each emulsion layer is gradually lowered in the direction of the support. Even in the three-layer constitution of this type, each of the same color-sensitivity layers may be composed of three layers of middle-sensitivity emulsion layer/high-sensitivity emulsion layer/low-sensitivity emulsion layer as formed in this order from the remotest side from the support, such as described in JP-A-59-202464.

As still other examples of the layer constitution of the photographic material of the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer. Where the photographic material of the invention has four or more layers, the layer constitution thereof may be varied in accordance with the manner mentioned above.

In order to improve the color reproducibility, it is preferred to provide a doner layer (CL) which has an interlayer effect and which has a different color sensitivity distribution from that of the light-sensitive layers of BL, GL and RL, adjacent to or near to the light-sensitive layers BL, GL and RL, in the manner such as described in U.S. Pat. Nos. 4,663,271, 4,705,744 and 4,707,436 and JP-A-62-160448 and JP-A-63-89850.

As mentioned above, various layer constitutions and arrangements may be selected in accordance with the object of the photographic material of the invention.

The silver halide which is preferably employed in the photographic emulsion layer which constitutes the photographic material of the present invention is silver iodobromide, silver iodochloride or silver iodochlorobromide having a silver iodide content of about 30 mol % or less. Especially preferred is a silver iodobromide or silver iodochlorobromide having a silver iodide content of from about 2 mol % to about 10 mol %.

The silver halide grains which are in the photographic emulsion which constitute the photographic material of the present invention may be regular crystalline grains such as cubic, octahedral or tetradecahedral grains, or irregular crystalline grains such as spherical or tabular grains, or irregular crystalline grains having a crystal defect such as a twin plane, or composite crystalline grains composed of the above-mentioned regular and irregular crystalline forms.

Regarding the grain size of the silver halide grains, the grains may be fine grains having a small grain size of about 0.2 micron or less or may be large ones having a large grain size of up to about 10 microns, as determined by the diameters of circles which correspond in area to the projected area of the grains. The emulsion of the grains may be either a polydispersed emulsion or a monodispersed emulsion.

The silver halide photographic emulsions which can be used in the present invention may be prepared by various methods, for example, those described in *Research Disclosure* (RD) No. 17643 (December, 1978), pages 22 to 23 (I. Emulsion Preparation and Types); RD No. 18716 (November, 1979), pages 648; RD No. 307105 (November 1989); P. Glafkides, *Chimie et Physique Photographique* (published by Paul Montel, 1967); G. F. Duffin, *Photographic Emulsion Chemistry* (published by Focal Press, 1966); and V. L. Zelikman et al, Making and Coating *Photographic Emulsion* (published by Focal Press, 1964).

Monodispersed emulsions, such as described in U.S. Pat. Nos. 3,574,628 and 3,655,394 and British Patent 1,413,748, are also preferably used in the present invention.

Additionally, tabular grains having an aspect ratio of about 3 or more may also be used in the present invention. Such tabular grains may easily be prepared in accordance with the various methods, for example, as described in Gutoff, *Photographic Science and Engineering*, Vol. 14, pages 248 to 257 (1970); and U.S. Pat. Nos. 4,434,226, 4,414,310, 4,433,048, 4,439,520 and British Patent 2,112,157.

Regarding the crystal structure of the silver halide grains which constitute the emulsions employed in the present invention, the grains may have the same halogen composition throughout the whole grain, or they may have different halogen compositions between the inside part and the outside part of one grain, or they may have a layered structure. Further, the grains may have different halogen compositions which are joined by an epitaxial bond, or they may have other components than silver halides, such as silver rhodanide or lead oxide, which are joined with the silver halide matrix. Additionally, a mixture of various grains of different crystalline forms may be employed in the present invention.

The above-mentioned emulsions for use in the present invention may be either surface latent image type ones which form latent images essentially on the surfaces of the grains or internal latent image type ones which form latent images essentially in the interior of the grains, or may also be surface/interior latent image type ones which form latent images both on the surfaces of the grains and in the interior of the grains. Anyhow, the emulsions are negative emulsions. As internal latent image type emulsions, they may be internal latent image type core/shell emulsions, such as described in JP-A-63-264740. A method of preparing such internal latent image type core/shell emulsions is described in JP-A-59-133542. The thickness of the shell of the emulsion grains of this type varies, depending upon the way of developing them, and is preferably from 3 to 40 nm, especially preferably from 5 to 20 nm.

The emulsions for use in the present invention are generally physically ripened, chemically ripened and/or color-sensitized. Additives to be used in such a ripening or sensitizing step are described in *Research Disclosure* Nos. 17643, 18716 and 307105, and the related descriptions in these references are shown in the table set forth below.

In the photographic material of the present invention, two or more emulsions which are different from one another in at least one characteristic of the light-sensitive silver halide grains which constitute the emulsion, which characteristic is selected from the grain size, the grain size distribution, the halogen composition, the shape and the sensitivity of the grains, can be incorporated into one and the same layer.

Surface-fogged silver halide grains such as described in U.S. Pat. No. 4,082,553; internally-fogged silver halide grains such as described in U.S. Pat. No. 4,626,498 and JP-A-59-214852; as well as colloidal silver may preferably be employed in the light-sensitive silver halide emulsion layers and/or substantially non-light-sensitive hydrophilic colloid layers which constitute the photographic material of the present invention. Internally-fogged or surface-fogged silver halide grains are such grains that can be non-imagewise uniformly developed at the both the non-exposed area and the exposed area of the photographic material. A method of preparing such internally-fogged or surface-fogged silver halide grains is described in U.S. Pat. No. 4,626,498 and JP-A-59-214852.

The silver halide which forms the inside nucleus of an internally-fogged core/shell type silver halide grain may be either one having the same halogen composition or one having a different halogen composition. The internally-fogged or surface-fogged silver halide may be any of silver chloride, silver chlorobromide, silver iodobromide or silver chloroiodobromide. The grain size of such a fogged silver halide grain is not particularly limited, and it is preferably from 0.01 to 0.75 μm, especially preferably from 0.05 to 0.6 μm, as a mean grain size. The shape of the grain is not also particularly limited, and it may be either a regular grain or an irregular grain. The emulsion containing such fogged grains may be either a monodispersed one or a polydispersed one. Preferred is a monodispersed one, in which at least 95% by weight or by number of all the silver halide grains therein have a grain size which falls within the range of the mean grain size ±40%.

The photographic material of the present invention preferably contain non-light-sensitive fine silver halide grains. Non-light-sensitive fine silver halide grains are meant to be fine silver halide grains which are not sensitive to the light as imparted to the photographic material for imagewise exposure thereof and are substantially not developed in the step of development of the exposed material. These fine grains preferably are not previously fogged.

The fine silver halide grains have a silver bromide content of from 0 to 100 mol % and, if desired, they may additionally contain silver chloride and/or silver iodide. Preferably, they contain silver iodide in an amount of from 0.5 to 10 mol %.

The fine silver halide grains preferably have a mean grain size (as a mean value of the diameters of circles which correspond in area to the projected area of the grains) of from 0.01 to 0.5 μm, more preferably from 0.02 to 0.2 μm.

The fine silver halide grains may be prepared by the same method as that of preparing ordinary light-sensitive silver halide grains. In this case, the surfaces of the fine silver halide grains to be prepared do not need to be chemically sensitized and color sensitization of the grains is unnecessary. However, prior to addition of the fine grains to the coating composition, it is preferred to previously add a known stabilizer, such as a triazole compound, an azaindene compound, a benzothiazolium compounds or, a mercapto compound or a zinc compound, to the coating composition. The fine silver halide grains-containing layer may preferably contain colloidal silver.

The amount of silver which is coated in the photographic material of the present invention is preferably 6.0 g/m$^2$ or less, most preferably 4.5 g/m$^2$ or less.

Various known photographic additives which may be used in preparing the photographic materials of the present invention are mentioned in the three above-mentioned *Research Disclosure* publications, and the related descriptions therein are shown in the following table.

| Kinds of Additives | RD 17643 | RD 18716 | RD 307105 |
|---|---|---|---|
| 1. Chemical Sensitizer | page 23 | page 648, right column | page 866 |
| 2. Sensitivity Enhancer | | page 648, right column | |
| 3. Color Sensitizing Agent, Super Color Sensitizing Agent | pages 23 to 24 | page 648, right column, to page 649, right column | pages 866 to 868 |
| 4. Brightening Agent | page 24 | | page 868 |
| 5. Anti-foggant, Stabilizer | pages 24 to 25 | page 649, right column | pages 868 to 870 |
| 6. Light Absorbent, Filter Dye, Ultraviolet Absorbent | pages 25 to 26 | page 649, right column to page 650, left column | page 873 |
| 7. Stain Inhibitor | page 25, right column | page 650, left column to right column | page 872 |
| 8. Color Image Stabilizer | page 25 | page 650, left column | page 872 |
| 9. Hardening Agent | page 26 | page 651, left column | pages 874 to 875 |
| 10. Binder | page 26 | page 651, left column | pages 873 to 874 |
| 11. Plasticizer, Lubricant | page 27 | page 650, right column | page 876 |
| 12. Coating Aid, Surfactant | pages 26 to 27 | page 650, right column | pages 875 to 876 |
| 13. Antistatic Agent | page 27 | page 650, right column | pages 876 to 877 |
| 14. Mat Agent | | | pages 878 to 879 |

In order to prevent deterioration of the photographic property of the photographic material of the present invention by formaldehyde gas which is imparted thereto, compounds capable of reacting with formaldehyde so as to solidify it, for example, those described in U.S. Pat. Nos. 4,411,987 and 4,435,503, are preferably incorporated into the material.

It is preferred to incorporate mercapto compounds, such as described in U.S. Pat. Nos. 4,740,454 and 4,788,132 and JP-A-62-18539 and JP-A-1-283551, into the photographic materials of the present invention.

It is also preferred to incorporate, into the photographic materials of the present invention, compounds capable of releasing a foggant, a development accelerator, a silver halide solvent or a precursor thereof, irrespective of the amount of the developed silver which is formed by development, such as described in JP-A-1-106052.

It is also preferred to incorporate, into the photographic materials of the present invention, dyes which are dispersed by the method described in International Patent Laid-Open No. WO88/04794 and JP-A-1-5029, or dyes such as described in European Patent 317,308A, U.S. Pat. No. 4,420,555 and JP-A-1-259358.

Various color couplers can be incorporated into the photographic material of the present invention, and examples of usable color couplers are described in patent publications as referred to in the above-mentioned *Research Disclosure* No. 17643, VII-C to G, and *Research Disclosure* No. 307105, VII-C to G.

Known yellow couplers may be employed in the present invention along with compounds of formula (1). As known yellow couplers, for example, those described in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and European Patent 249,473A are preferred.

As magenta couplers, 5-pyrazolone compounds and pyrazoloazole compounds are preferred. For instance, those described in U.S. Pat. Nos. 4,310,619, 4,351,897, European Patent 73,636, U.S. Pat. Nos. 3,061,432, 3,725,067, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630, and WO(PCT)88/04795 are preferred.

As cyan couplers, phenol couplers and naphthol couplers are preferred. For instance, those described in U.S. Pat. Nos. 4,052,212, 4,146,396, 4,228,122, 4,296,200, 2,369,929, 2,801,171, 2,771,162, 2,895,826, 3,772,002, 3,758,308, 4,334,011, 4,327,173, German Patent (OLS) No. 3,329,729, European Patents 121,365A, 249,453A, U.S. Pat. Nos. 3,446,622, 4,333,999, 4,775,616, 4,451,559, 4,427,767, 4,690,889, 4,254,212, 4,296,199, and JP-A-61-42658 are preferred. In addition, pyrazoloazole couplers such as described in JP-A-64-553, JP-A-64-554, JP-A-64-555 and JP-A-64-556 and imidazole couplers such as described in U.S. Pat. No. 4,818,672 can also be used.

Polymerized dye-forming couplers may also be used, and typical examples of such couplers are described in U.S. Pat. Nos. 3,451,820, 4,080,211, 4,367,282, 4,409,320, 4,576,910, British Patent 2,102,137 and European Patent 341,188A.

Couplers capable of forming colored dyes having a desirable diffusibility may also be used, and those described in U.S. Pat. No. 4,366,237, British Patent 2,125,570, European Patent 96,570, and German Patent OLS No. 3,234,533 are preferred.

As colored couplers for correcting undesired absorption of colored dyes, those described in RD No. 17643, VII-G, RD No. 307105, VII-G, U.S. Pat. No. 4,163,670, JP-B-57-39413, U.S. Pat. Nos. 4,004,929, 4,138,258, and British Patent 1,146,368 are preferred. Additionally, couplers for correcting undesired absorption of colored dyes by releasing a phosphor dye during coupling, as described in U.S. Pat. No. 4,774,181, as well as couplers having a dye precursor group capable of reacting with a developing agent to form a dye, as a split-off groups, as described in U.S. Pat. No. 4,777,120 are also preferably used.

Couplers capable of releasing a photographically useful group during coupling may also be used in the present invention. For instance, as DIR couplers for releasing a development inhibitor, those described in the patent publications as referred to in the above-mentioned RD No. 17643, Item VII-F, RD No. 307105, Item VII-F, as well as those described in JP-A-57-151944, JP-A-57-154234, JP-A-60-184248, JP-A-63-37346 and JP-A-63-37350 and U.S. Pat. Nos. 4,248,962 and 4,782,012 are preferred.

Couplers for releasing a bleaching accelerator, as described in RD Nos. 11449 and 24241 and JP-A-61-201247, are effective for shortening the time for the processing step with a processing solution having a bleaching capacity, and the effect is especially noticeable when they are added to the photographic material of the present invention which contains the above-mentioned tabular silver halide grains.

As couplers for imagewise releasing a nucleating agent or development accelerator during development, those described in British Patents 2,097,140 and 2,131,188, and JP-A-59-157638 and JP-A-59-170840 are preferred. In addition, compounds for releasing a fogant, a development accelerator or a silver halide solvent by redox reaction with an oxidation product of a developing agent, as described in JP-A-60-107029, JP-A-60-252340, JP-A-1-44940 and JP-A-1-45687, are also preferably used.

Additionally, as examples of compounds which may be incorporated into the photographic materials of the present invention, there are further mentioned competing couplers such as described in U.S. Pat. No. 4,130,427; polyvalent couplers such as described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds such as described in JP-A-60-185950 and JP-A-62-24252; couplers for releasing a dye which recolors after being released from the coupler, such as described in European Patents 173,302A and 313,308A; ligand-releasing couplers such as described in U.S. Pat. No. 4,555,477; leuco dye-releasing couplers such as described in JP-A-63-75747; and couplers for releasing a phosphor dye such as described in U.S. Pat. No. 4,774,181.

The above-mentioned couplers can be incorporated into the photographic materials of the present invention by various known dispersion methods.

For instance, an oil-in-water dispersion method may be employed for this purpose. Examples of high boiling point solvents usable in the method are described in U.S. Pat. No. 2,322,027. As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline compounds (e.g., N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately from 30° to 160° C., preferably from 50° to 160° C. can be used. As examples of such auxiliary organic solvents, there are mentioned ethyl acetate, butyl acetate, ethyl propionate, methyl ethyl ketone, cyclohexanone, 2-ethoxyethyl acetate and dimethylformamide.

A latex dispersion method may also be employed for incorporating couplers into the photographic material of the present invention. The steps for carrying out the latex dispersion method, the effect of the method and examples of latexes usable in the method for impregnation are described in U.S. Pat. No. 4,199,363, German Patent (OLS) Nos. 2,541,274 and 2,541,230.

The color photographic material of the present invention preferably contains an antiseptic or fungicide of various kinds, for example, selected from phenethyl alcohol and those described in JP-A-63-257747, JP-A-62-272248 and 1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 897.

It is desired that the total film thickness of all the hydrophilic colloid layers which are provided on the side of the support which contains the emulsion layers is 28 microns or less, preferably 23 microns or less, more preferably 18 microns or less, especially preferably 16 microns or less, in the photographic material of the present invention. It is also desired that the photographic material of the present invention has a film welling rate ($T_{\frac{1}{2}}$) of 30 seconds or less, preferably 20 seconds or less. The film thickness as referred to herein is one which is measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., *Photographic Science Engineering*, Vol. 19, No. 2, pages 124 to 129. The film swelling rate ($T_{\frac{1}{2}}$) is defined as follows: 90% of the maximum swollen thickness of the photographic material as processed in a color developer under the condition of 30° C. and 3 minutes and 15 seconds is called a saturated swollen thickness. The time necessary for attaining half ($\frac{1}{2}$) of the saturated swollen thickness is defined to be a film swelling rate ($T_{\frac{1}{2}}$).

The film swelling rate ($T_{\frac{1}{2}}$) can be adjusted by adding a hardening agent to a gelatin binder or by varying the condition of storing the coated photographic material. Additionally, the photographic material of the present invention preferably has a swelling degree of from 150 to 400%. The swelling degree as referred to herein is calculated from the maximum swollen film thickness as obtained under the above-mentioned condition, on the basis of the following formula:

(maximum swollen film thickness − original film thickness)/(original film thickness)

It is preferred that the photographic material of the present invention has a hydrophilic colloid layer having a total dry thickness of from 2 μm to 20 μm on the side opposite to the side which contains the emulsion layers. This layer is referred to as a backing layer. It is preferred that the backing layer contains various additives such as the above-mentioned light absorbent, filter dye, ultraviolet absorbent, antistatic agent, hardening agent, binder, plasticizer, swelling agent, coating aid and surfactant. The backing layer is desired to have a swelling degree of from 150 to 500%.

The color photographic material of the present invention can be developed by any ordinary method, for example, in accordance with the process described in the above-mentioned RD No. 17643, pages 28 and 29, RD No. 18716, page 615, from left column to right column, and RD No. 307105, pages 880 to 881.

The color developer to be used for development of the photographic material of the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-( 4-hydroxybutyl)aniline, 4-amino-3-methoxy-N-ethyl-N-(4-hydroxybutyl)aniline, 4-amino-3-ethoxy-N, N-bis (5-hydroxypentyl) aniline, 4-amino-3-propyl-N- (4-hydroxybutyl) aniline, as well as sulfates, hydrochlorides and p-toluenesulfonates of these compounds. Above all, especially preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and their hydrochlorides, p-toluenesulfonates and sulfates. These compounds can be used in combination of two or more of them, in accordance with the object.

The color developer generally contains a pH buffer such as alkali metal carbonates, borates or phosphates, and a development inhibitor or anti-foggant such as chlorides, bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediaminetetraacetic acid, nitrilo-triacetic acid, diethylenetriaminepentaacetic acid, cyclohexanediaminetetraacetic acid, hydroxylethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and their salts.

Where the photographic material is processed for reversal finishing, in general, it is first subjected to black-and-white development and then subjected to color development. For the first black-and-white development there is used a black-and-white developer, which contains a conventional black-and-white developing agent, for example, dihydroxybenzenes such as hydroquinone, 3-pyraozlidones such as 1-phenyl-3-pyraozlidone, or amino-phenols such as N-methyl-p-aminophenol, singly or in combination. The color developer and the black-and-white developer generally has a pH value of from 9 to 12. The amount of the replenisher to the developer is, though depending upon the the color photographic material to be processed, generally 3 liters or less per $m^2$ of the material to be processed. It may be reduced to 500 ml or less per $m^2$ of the material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

Opening Ratio = (Contact Surface Area ($cm^2$) of Processing Solution with Air)/(Volume ($cm^3$) of Processing Tank)

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid described in JP-A-1-82033 and employment of the slit-developing method described in JP-A-63-216050. Reduction of the opening ratio is preferably applied to not only both steps of color development and black-and-white development, but also all the subsequent steps such as bleaching, bleach-fixation, fixation, rinsing and stabilization steps. In addition, the amount of the replenisher to be added may also be reduced by means of suppressing accumulation of bromide ions in the developer.

The time for color development is generally from 2 minutes to 5 minutes, but the processing time may be shortened by elevating the processing temperature, elevating the pH value of the processing solution and elevating the concentration of the processing solution.

After being color developed, the photographic emulsion layer is generally subjected to desilvering by bleaching and fixing. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath comprised of two continuous tanks, a system of fixation followed by bleach-fixation, or a system of bleach-fixation followed by bleaching may also be employed, in accordance with the object. As the bleaching agent there can be used, for example, compounds of polyvalent metals such as iron(III), as well as peracids, quinones and nitro compounds. Specific examples of the bleaching agent usable in the present invention include organic complexes of iron(III), such as complexes thereof with amino-polycarboxylic acids such as ethylenediaminetetraacetic acid, diethylenetriaminepentaacetic acid, cyclohexanediamine-tetraacetic acid, methyliminodiacetic acid, 1,3-diaminopropane-tetraacetic acid or glycol ether-diamine-tetraacetic acid or with organic acids such as citric acid, tartaric acid or malic acid. Among them, aminopolycarboxylato/iron(III) complexes such as ethylene-diaminetetraacetato/iron(III) complex and 1,3-diaminopropane-tetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8.0, but the solution may have a lower pH value for rapid processing.

The bleaching solution, the bleach-fixing solution and a previous bath may contain a bleaching accelerating agent, if desired. Various bleaching accelerating agents are known, and examples of the agents which are advantageously used in the present invention include mercapto group- or disulfide group-containing compounds described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, RD No. 17129 (July, 1978); thiazolidine compounds as described in JP-A-50-140129; thiourea compounds as described in JP-B-45-8506, JP-A-52-20832 and JP-A-53-32735 and U.S. Pat. No. 3,706,561; iodide salts as described in German Patent 1,127,715 and JP-A-58-16235; polyoxyethylene compounds as described in German Patents 966,410 and 2,748,430; polyamine compounds as described in JP-B 45-8836; other compounds as described in JP-A-49-40943, JP-A-49-59644, JP-A-53-94927, JP-A-54-35727, JP-A-55-26506 and JP-A-58-163940; and bromide ions. Above all, mercapto group- or disulfide group-containing compounds, in particular, those as described in U.S. Pat. No. 3,893,858, German Patent 1,290,812 and JP-A-53-95630 are preferred, as having a large accelerating effect. In addition, compounds described in U.S. Pat. No. 4,552,834 are also preferred. These bleaching accelerators may be incorporated into the photographic material of the present invention. Where the material of the present invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for this purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material of the present invention, usable are thiosulfates, thiocyanates, thioether compounds, thioureas, and a large amount of iodide salts. Thiosulfates are generally used for this purpose. Above all, ammonium thiosulfate is most widely used. Additionally, a combination of thiosulfates and thiocyanates, thioether compounds or thioureas is also preferred. As the preservative which can be in the fixing solution or bleach-fixing solution, preferred are sulfites, bisulfites and carbonyl-bisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

It is preferred that the fixing solution or bleach-fixing solution to be used for processing the photographic material of the present invention contains compounds having a pKa value of from 6.0 to 9.0, for the purpose of adjusting the pH value of the solution. As such compounds, preferably added are imidazoles such as imidazole, 1-methylimidazole, 1-ethylimidaozle or 2-mehtylimidazole, in an amount of from 0.1 to 10 mol/liter.

The total time for the desilvering process is preferably as short as possible as long as the time does not cause desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

In the desilvering process, it is desired that stirring of the processing solution during the process is promoted as much as possible. As examples of reinforced stirring means for forcedly stirring the photographic material during the desilvering step, there are mentioned a method of running a jet stream of the processing solution onto the emulsion-coated surface of the material, as described in JP-A-62-183460; a method of promoting the stirring effect by the use of a rotating means, as described in JP-A-62-183461; a method of moving the photographic material being processed in the processing bath while the emulsion-coated surface of the material is brought into contact with a wiper blade as provided in the processing bath, whereby the processing solution which is applied to the emulsion-coated surface of the material is made turbulent and the stirring effect is promoted; and a method of increasing the total circulating amount of the processing solution. Such reinforced stirring means are effective for use with any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the material would be elevated. The above-mentioned reinforced stirring means is more effective, when a bleaching accelerator is incorporated into the processing solution. Because of the stirring means, therefore, the bleaching accelerating effect can remarkably be augmented, and the fixation preventing effect caused by the bleaching accelerator could be decreased or dissolved.

The photographic material of the present invention can be processed with an automatic developing machine. It is desired that the automatic developing machine to be used for processing the material of the present invention is equipped with a photographic material-conveying means as described in JP-A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of these reasons, the conveying means is especially effective for shortening the processing time in each processing step and for reducing the amount of the replenisher to each processing bath.

The silver halide color photographic material of the present invention is generally rinsed in water and/or stabilized, after being desilvered. The amount of the water to be used in the rinsing step can be set in a broad range, in accordance with the characteristic of the photographic material being processed (for example, depending upon the raw material components, such as the coupler and so on) or the use of the material, as well as the temperature of the rinsing water, the number of the rinsing tanks (the number of the rinsing stages), the replenishment system of co-current or countercurrent flow and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of the rinsing water to be used can be reduced noticeably, but because of the prolongation of the residence time of the water in the rinsing tank, bacteria would propagate in the tank so that the floating substances generated by the propagation of bacteria would adhere to the surface of the material as it was processed. Accordingly, the above system would often have a problem. In the practice of processing the photographic material of the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents* (1986, by Sankyo Publishing Co., Japan), *Bactericidal and Fungicidal Techniques to Microorganisms*, edited by Association of Sanitary Technique, Japan (1982, by Kogyo Gijutsukai, Japan), and *Encyclopedia of Bactericidal and Fungicidal Agents,* edited by Nippon Bactericide and Fungicide Association, Japan (1986), can also be used.

The pH value of the rinsing water which can be used for processing the photographic material of the present invention generally is from 4 to 9, preferably from 5 to 8. The temperature of the rinsing water and the rinsing time can also be set at various values in accordance with the characteristics of the photographic material being processed as well as the use thereof, and in general, the temperature is from 15° to 45° C. and time is from 20 seconds to 10 minutes, and preferably the temperature is from 25° to 40° C. and the time is from 30 seconds to 5 minutes. Alternatively, the photographic material of the present invention may also be processed directly with a stabilizing solution in place of being rinsed with water. For the stabilization, any known methods, for example, as described in JP-A-57-8543, JP-A-58-14834 and JP-A-60-220345, can be employed.

In addition, the material can also be stabilized, following the rinsing step. As one example of this case, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylenetetramine and aldehydesulfite adducts. The stabilizing bath may also contain various chelating agents and fungicides.

The overflow from the rinsing and/or stabilizing solutions because of addition of replenishers thereto may be re-used in the other steps such as the previous desilvering step.

Where the photographic material of the present invention is processed with an automatic developing machine system and the processing solutions which are being used in the various steps are evaporated and thickened, it is desired to add water to the solutions so as to correct the concentration of the solutions.

The silver halide color photographic material of the present invention can contain a color developing agent for the purpose of simplifying and accelerating the processing of the material. For incorporation of a color developing agent into the photographic material, various precursors of the agent are preferably used. For example, there are mentioned indoaniline compounds described in U.S. Pat. No. 3,342,597, Schiff base compounds described in U.S. Pat. No. 3,342,599 and RD Nos. 14850 and 15159, aldole compounds described in RD No. 13924, metal complexes described in U.S. Pat. No. 3,719,492 and urethane compounds described in JP-A-53-135628, as the precursors.

The silver halide color photographic material of the present invention can contain various kinds of phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic material of the invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solution used.

The silver halide color photographic material of the present invention is especially effectively applied to lens-combined film units such as those described in JP-B-2-32615 and Japanese Utility Model Publication No. 3-39784, as easily expressing the effect.

Next, the present invention will be explained in more detail by way of the following examples, which, however, are not intended to restrict the scope of present invention.

EXAMPLE 1

Plural layers each having the composition mentioned below were coated on a subbing layer-coated cellulose triacetate support, to prepare a multi-layer color photographic material Sample 101.

Compositions of Photographic Layers

Various components which constitute the photographic layers are grouped as follows:

ExC: Cyan Coupler
UV: Ultraviolet Absorbent
ExM: Magenta Coupler
HBS: High Boiling Point Organic Solvent
ExY: Yellow Coupler
H: Gelatin Hardening Agent
ExS: Sensitizing Dye The amounts of silver halide and colloidal silver coated each are represented by g/m$^2$ as the amount of silver therein. The amounts of coupler, additive and gelatin coated each are represented by g/m$^2$. The amount of sensitizing dye coated is represented by way of the molar number per mol of silver halide in the same layer.

| Sample 101: | Amount |
|---|---|
| First Layer: Anti-halation Layer | |
| Black Colloidal Silver | 0.25 |
| Gelatin | 0.90 |
| ExM-1 | $1.0 \times 10^{-2}$ |
| HBS-1 | $3.0 \times 10^{-2}$ |
| Second Layer: Interlayer | |
| Gelatin | 0.80 |
| UV-1 | $3.0 \times 10^{-2}$ |
| UV-2 | $6.0 \times 10^{-2}$ |
| UV-3 | $7.0 \times 10^{-2}$ |
| ExF-1 | $1.0 \times 10^{-3}$ |
| HBS-2 | $7.0 \times 10^{-2}$ |
| Third Layer: Low-sensitivity Red-sensitive Emulsion Layer | |
| Emulsion A | 0.15 as Ag |
| Emulsion B | 0.20 as Ag |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.11 |
| ExC-3 | 0.11 |
| ExC-4 | $3.0 \times 10^{-2}$ |
| ExC-7 | $1.0 \times 10^{-2}$ |
| HBS-1 | $7.0 \times 10^{-3}$ |
| Fourth Layer: Middle-sensitivity Red-sensitive Emulsion Layer | |
| Emulsion C | 0.25 as Ag |
| Emulsion D | 0.35 as Ag |
| Gelatin | 1.50 |
| ExS-1 | $1.0 \times 10^{-4}$ |
| ExS-2 | $3.0 \times 10^{-4}$ |
| ExS-3 | $1.0 \times 10^{-5}$ |
| ExC-1 | 0.16 |
| ExC-2 | $8.0 \times 10^{-2}$ |
| ExC-3 | 0.17 |
| ExC-7 | $1.5 \times 10^{-2}$ |
| ExY-1 | $2.0 \times 10^{-2}$ |
| ExY-2 | $1.0 \times 10^{-2}$ |
| Cpd-10 | $1.0 \times 10^{-4}$ |
| HBS-1 | 0.10 |
| Fifth Layer: High-sensitivity Red-sensitive Emulsion Layer | |
| Emulsion E | 0.60 as Ag |
| Gelatin | 1.20 |
| ExS-1 | $1.0 \times 10^{-4}$ |
| ExS-2 | $3.0 \times 10^{-4}$ |
| ExS-3 | $1.0 \times 10^{-5}$ |
| ExC-5 | $7.0 \times 10^{-2}$ |

-continued

| Sample 101: | Amount |
|---|---|
| ExC-6 | $8.0 \times 10^{-2}$ |
| ExC-7 | $1.5 \times 10^{-2}$ |
| HBS-1 | 0.11 |
| HBS-2 | $8.0 \times 10^{-2}$ |
| Sixth Layer: Interlayer | |
| Gelatin | 0.50 |
| P-2 | 0.17 |
| Cpd-1 | 0.10 |
| Cpd-4 | 0.17 |
| HBS-1 | $5.0 \times 10^{-2}$ |
| Seventh Layer: Low-sensitivity Green-sensitive Emulsion Layer | |
| Emulsion F | 0.10 as Ag |
| Emulsion G | 0.15 as Ag |
| Gelatin | 0.50 |
| ExS-4 | $5.0 \times 10^{-4}$ |
| ExS-5 | $2.0 \times 10^{-4}$ |
| ExS-6 | $0.3 \times 10^{-4}$ |
| ExM-1 | $3.0 \times 10^{-2}$ |
| ExM-2 | 0.20 |
| ExY-1 | $3.0 \times 10^{-2}$ |
| Cpd-11 | $7.0 \times 10^{-3}$ |
| HBS-1 | 0.20 |
| Eighth Layer: Middle-sensitivity Green-sensitive Emulsion Layer | |
| Emulsion H | 0.55 as Ag |
| Gelatin | 1.00 |
| ExS-4 | $5.0 \times 10^{-4}$ |
| ExS-5 | $2.0 \times 10^{-4}$ |
| ExS-6 | $3.0 \times 10^{-5}$ |
| ExM-1 | $3.0 \times 10^{-2}$ |
| ExM-2 | 0.25 |
| ExM-3 | $2.5 \times 10^{-2}$ |
| ExY-1 | $4.0 \times 10^{-2}$ |
| Cpd-11 | $9.0 \times 10^{-3}$ |
| HBS-1 | 0.20 |
| Ninth Layer: High-sensitivity Green-sensitive Emulsion Layer | |
| Emulsion I | 0.45 as Ag |
| Gelatin | 0.90 |
| ExS-4 | $2.0 \times 10^{-4}$ |
| ExS-5 | $2.0 \times 10^{-4}$ |
| ExS-6 | $2.0 \times 10^{-5}$ |
| ExS-7 | $3.0 \times 10^{-4}$ |
| ExM-1 | $2.5 \times 10^{-2}$ |
| ExM-4 | $3.9 \times 10^{-2}$ |
| ExM-5 | $2.6 \times 10^{-2}$ |
| ExY-1 | $1.2 \times 10^{-2}$ |
| Cpd-2 | $1.0 \times 10^{-2}$ |
| Cpd-9 | $2.0 \times 10^{-4}$ |
| Cpd-10 | $2.0 \times 10^{-4}$ |
| HBS-1 | 0.20 |
| HBS-2 | $5.0 \times 10^{-2}$ |

-continued

| Sample 101: | Amount |
|---|---|
| Tenth Layer: Yellow Filter Layer | |
| Gelatin | 0.50 |
| Yellow Colloid | $8.0 \times 10^{-2}$ |
| Cpd-1 | 0.20 |
| HBS-1 | 0.15 |
| Eleventh Layer: Low-sensitivity Blue-sensitive Emulsion Layer | |
| Emulsion J | 0.10 as Ag |
| Emulsion K | 0.20 as Ag |
| Gelatin | 1.00 |
| ExS-8 | $2.0 \times 10^{-4}$ |
| ExY-1 | $9.0 \times 10^{-2}$ |
| ExY-3 | 0.90 |
| Cpd-2 | $1.0 \times 10^{-2}$ |
| HBS-1 | 0.30 |
| Twelfth Layer: High-sensitivity Blue-sensitive Emulsion Layer | |
| Emulsion L | 0.40 as Ag |
| Gelatin | 0.60 |
| ExS-8 | $1.0 \times 10^{-4}$ |
| ExY-3 | 0.15 |
| Cpd-2 | $1.0 \times 10^{-3}$ |
| HBS-1 | $4.0 \times 10^{-2}$ |
| Thirteenth Layer: First Protective Layer | |
| Fine Silver Iodobromide Grains (mean grain size 0.07 μm; silver iodide content 1 mol %) | 0.20 |
| Gelatin | 0.50 |
| UV-2 | 0.10 |
| UV-3 | 0.10 |
| UV-4 | 0.20 |
| HBS-3 | $4.0 \times 10^{-2}$ |
| P-3 | $9.0 \times 10^{-2}$ |
| Fourteenth Layer: Second Protective Layer | |
| Gelatin | 0.40 |
| B-1 (diameter 1.5 μm) | 0.10 |
| B-2 (diameter 1.5 μm) | 0.10 |
| B-3 | $2.0 \times 10^{-2}$ |
| H-1 | 0.40 |

In addition, the photographic material contained the following Cpd-3, Cpd-5 through Cpd-8, P-1, P-2, W-1 through W-3, so as to have improved storability, processability, pressure resistance, fungicidal and bactericidal property, antistatic property and coatability.

In addition, they optionally contained B-4, F-1 through F-11, an iron salt, a lead salt, a gold salt, a platinum salt, an iridium salt and a rhodium salt.

Structural formulae or names of the compounds used as well as the the emulsions used are shown below.

TABLE 1

| | Mean AgI Content (%) | Mean Grain Size (as sphere-corresponding diameter) (μm) | Variation Coefficient of Grain Size Distribution (%) | Ratio of Diameter/ Thickness | Mean Diameter (as circle-corresponding diameter of projected area) (μm) | Mean Thickness (μm) | Grain Structure; ratio of silver content (ratio of AgI % content) |
|---|---|---|---|---|---|---|---|
| Emulsion A | 2.0 | 0.2 | 12 | 1 | — | — | uniform tetradecahedral grains |
| Emulsion B | 2.0 | 0.3 | 14 | 1 | — | — | uniform tetradecahedral grains |
| Emulsion C | 4.7 | 0.3 | 12 | 1 | — | — | three-layered tetradecahedral grains; 4/1/5 (1/38/1) |
| Emulsion D | 4.7 | 0.5 | 8 | 1 | — | — | three-layered tetradecahedral grains; 4/1/5 (1/38/1) |
| Emulsion E | 8.8 | 0.65 | 17 | 6.5 | 1.06 | 0.16 | three-layered tabular grains; 12/59/29 (0/11/8) |
| Emulsion F | 2.9 | 0.15 | 16 | 1 | — | — | three-layered octahedral grains; 45/5/50 (1/38/1) |
| Emulsion G | 2.9 | 0.25 | 18 | 1 | — | — | three-layered octahedral grains; 45/5/50 (1/38/1) |
| Emulsion H | 4.7 | 0.45 | 10 | 1 | — | — | three-layered octahedral grains; 4/1/5 (1/38/1) |
| Emulsion I | 8.8 | 0.60 | 18 | 7.2 | 1.01 | 0.14 | three-layered tabular grains; 12/59/29 (0/11/8) |
| Emulsion J | 3.0 | 0.2 | 30 | 4.5 | 0.29 | 0.064 | uniform tabular grains |
| Emulsion K | 3.0 | 0.5 | 26 | 7.0 | 0.84 | 0.12 | uniform tabular grains |

TABLE 1-continued

| | Mean AgI Content (%) | Mean Grain Size (as sphere-corresponding diameter) (μm) | Variation Coefficient of Grain Size Distribution (%) | Ratio of Diameter/ Thickness | Mean Diameter (as circle-corresponding diameter of projected area) (μm) | Mean Thickness (μm) | Grain Structure; ratio of silver content (ratio of AgI % content) |
|---|---|---|---|---|---|---|---|
| Emulsion L | 9.0 | 0.75 | 18 | 6.5 | 1.39 | 0.21 | three-layered tabular grains; 8/59/33 (0/11/8) |

In Table 1 above;

(1) the respective emulsions were subjected to reduction sensitization with thiourea dioxide and thiosulfonic acid during formation of the grains, in accordance with the example of JP-A-2-191938;

(2) the respective emulsions were subjected to gold sensitization, sulfur sensitization and selenium sensitization in the presence of the color sensitizing dyes in the respective layers and sodium thiocyanate, in accordance with the example of JP-A-3-237450;

(3) a low molecular gelatin was employed in preparing the tabular grains, in accordance with the example of JP-A-1-158426;

(4) the tabular grains and the grain-structural normal crystalline grains were observed to have dislocation lines, such as those described in JP-A-3-237450, with a high-pressure electronic microscope.

UV-1

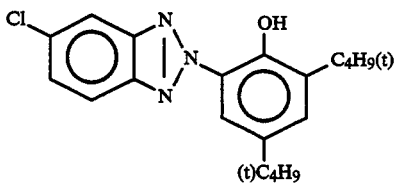

UV-2

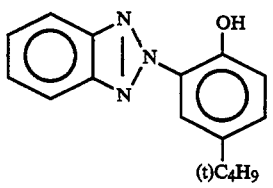

UV-3

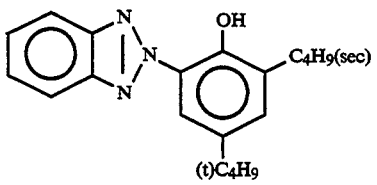

UV-4

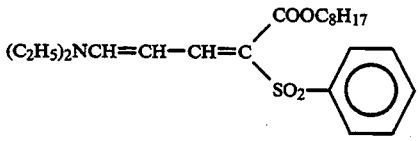

Tricresyl Phosphate
Tri(2-ethylhexyl)phosphate

HBS-1
HBS-3

Dibutyl Phthalate

HBS-2
ExF-1

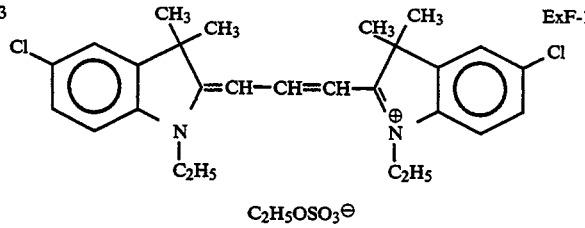

ExC-1

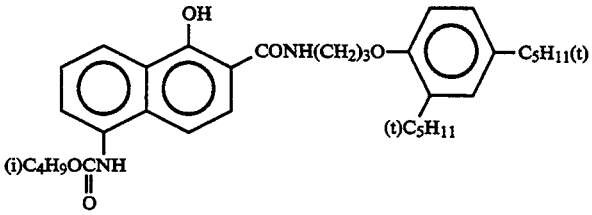

ExC-2

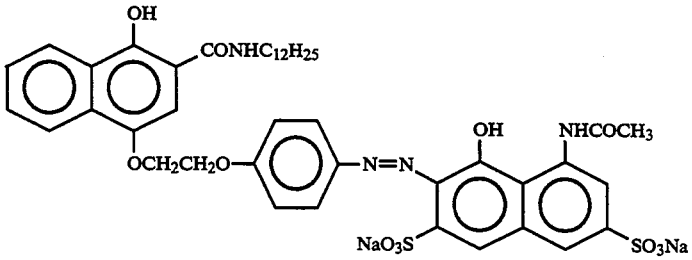

-continued
ExC-3
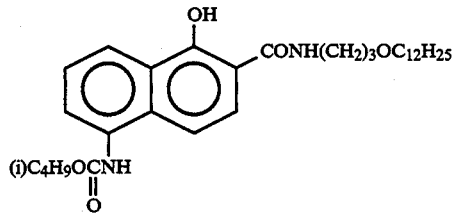
ExC-4
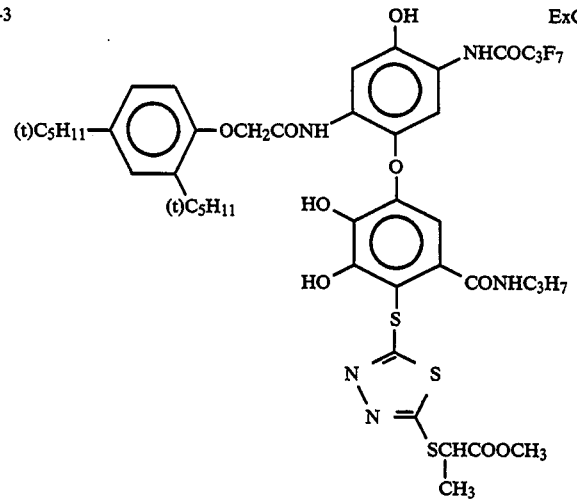
ExC-5
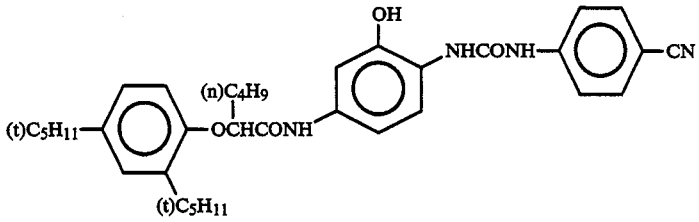
ExC-6
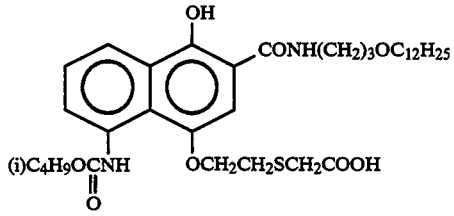
ExC-7
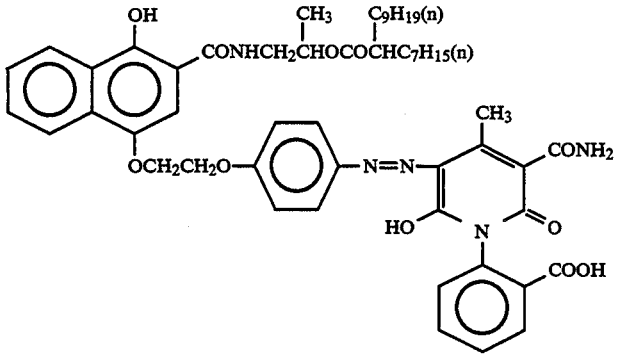
ExM-1
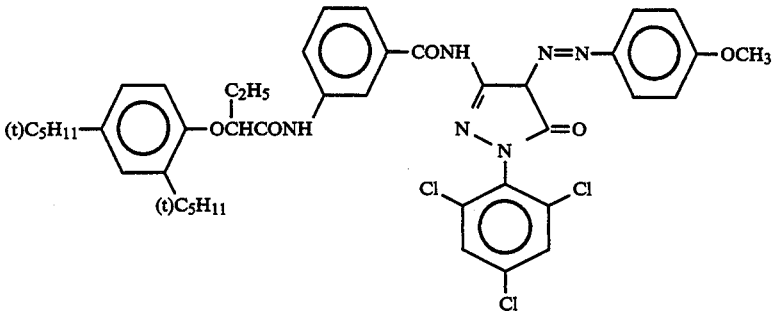

-continued
ExM-2
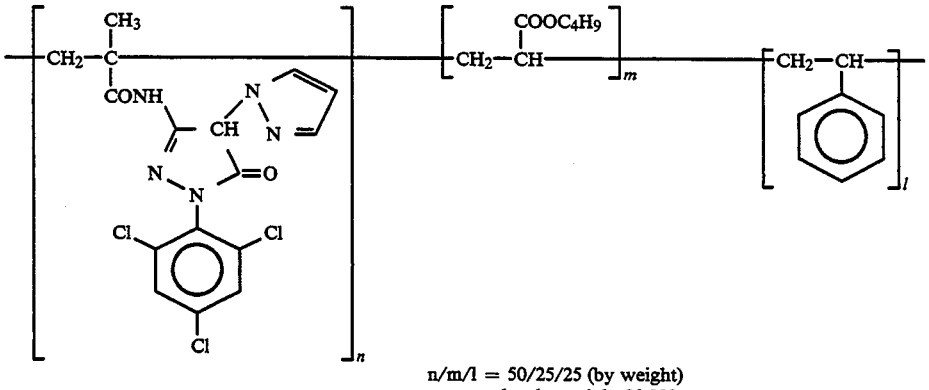
n/m/l = 50/25/25 (by weight)
mean molecular weight 20,000
ExM-3
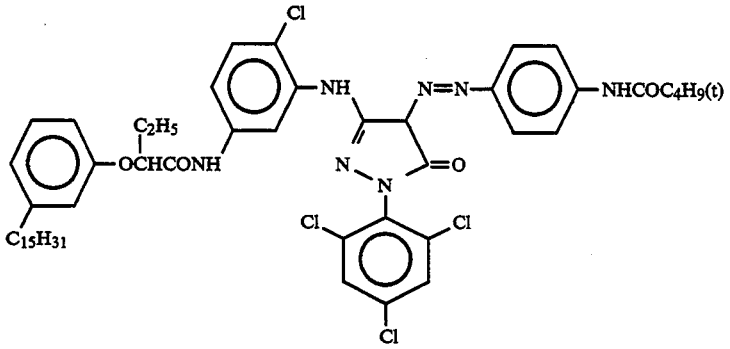
ExM-4
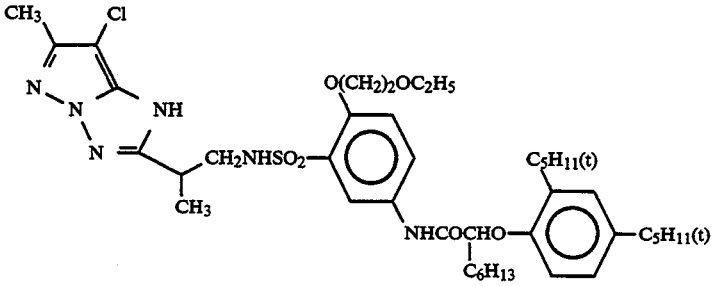
ExM-5
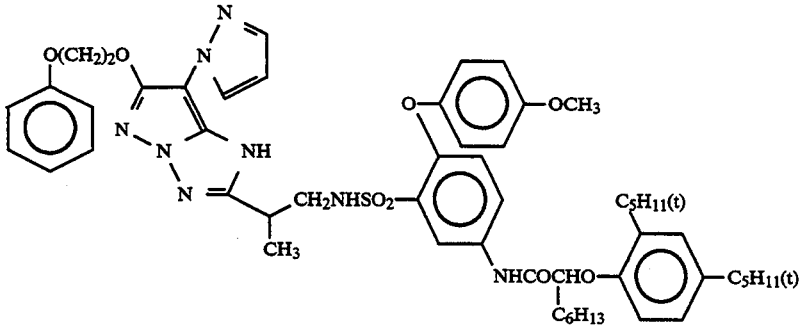
ExY-1
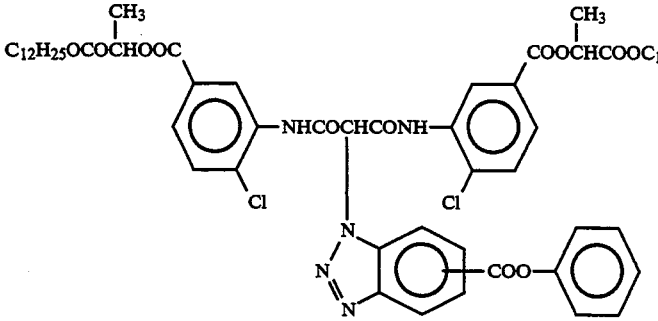

-continued
ExY-2
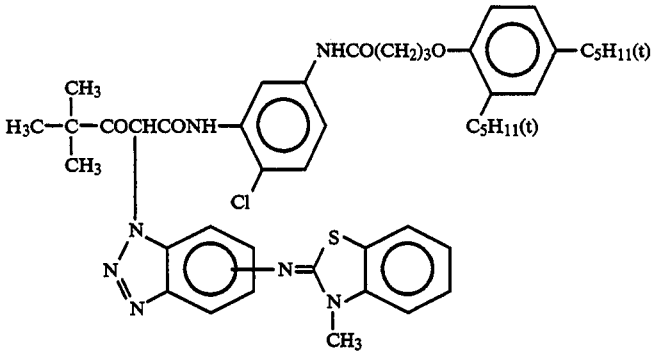
(Coupler 1 of Research Disclosure No. 18053)
ExY-3
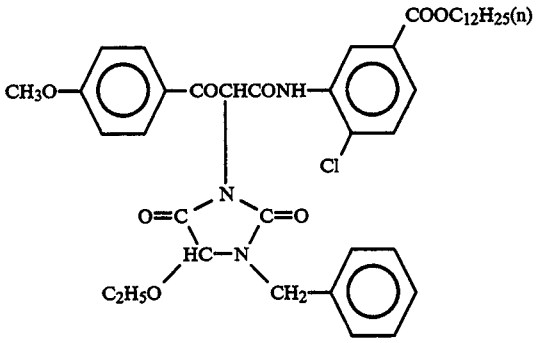
Cpd-1
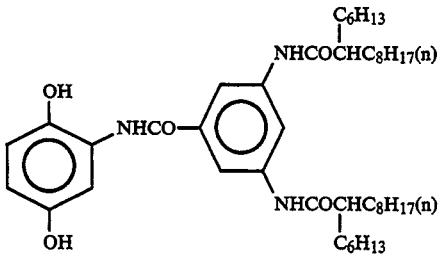
Cpd-2
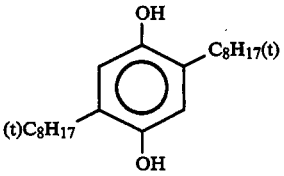
Cpd-3
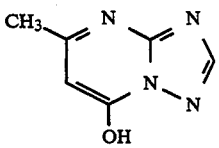
Cpd-4
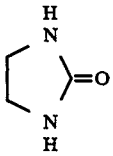
Cpd-5
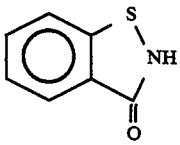
Cpd-6
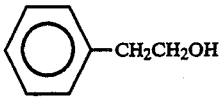
Cpd-7
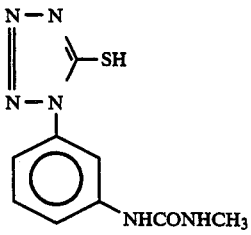
Cpd-8
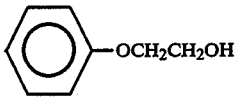
Cpd-9
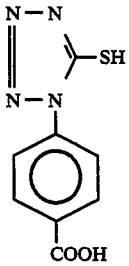

-continued
Cpd-10
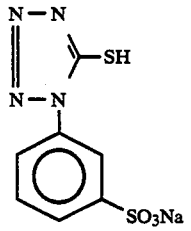
Cpd-11
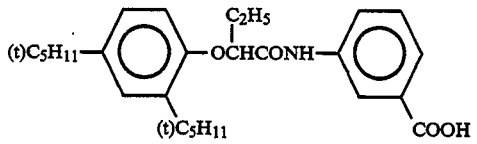
ExS-1
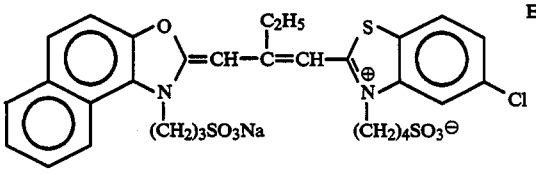
ExS-2
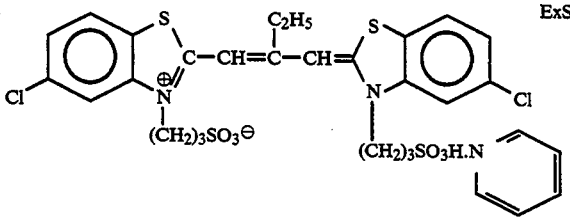
ExS-3
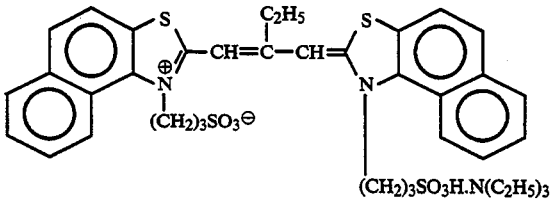
ExS-4
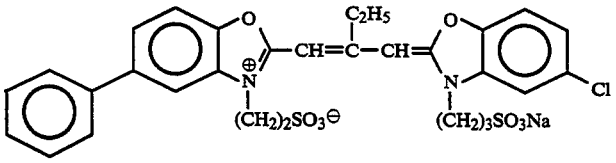
ExS-5
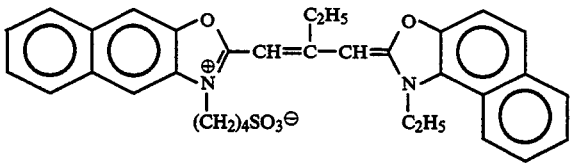
ExS-6
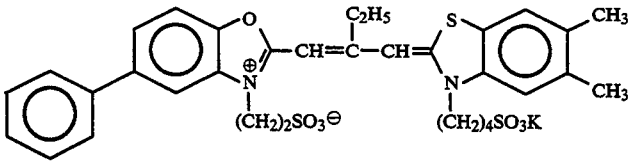
ExS-7
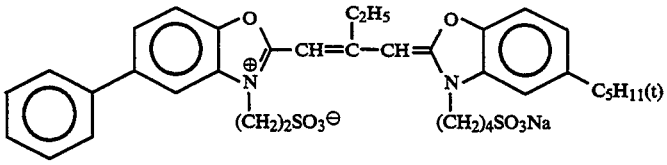
ExS-8
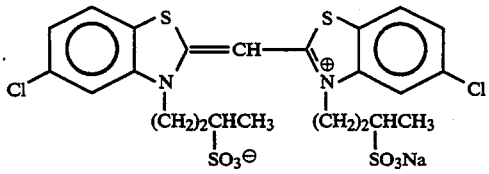
B-1
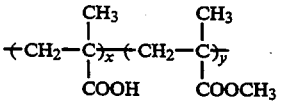
x/y = 10/90

-continued

B-2

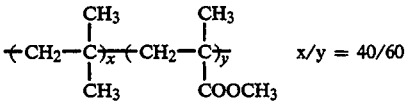

x/y = 40/60

B-3

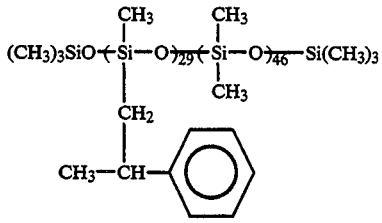

B-4

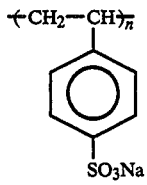

H-1

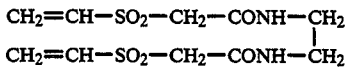

W-1

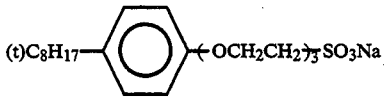

W-2

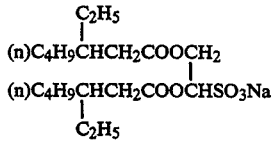

W-3

$C_8F_{17}SO_2N(C_3H_7)CH_2COOK$

P-1

Copolymer of Vinyl Pyrrolidone and Vinyl Alcohol (70/30, by weight)

P-2

Polyvinyl Pyrrolidone (mean molecular weight; about 10,000)

P-3

Polyethyl Acrylate

F-1

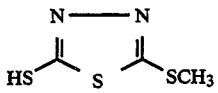

F-2

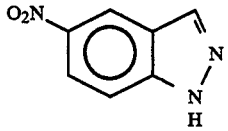

F-3

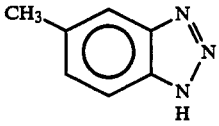

F-4

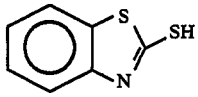

F-5

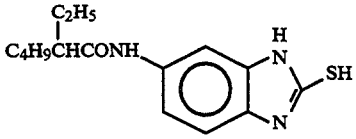

F-6

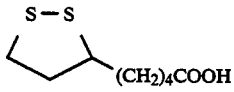

F-7

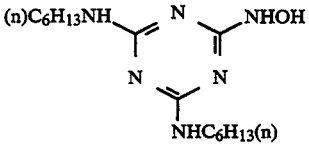

F-8

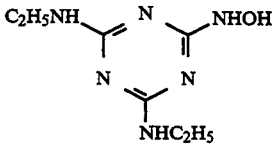

F-9

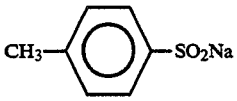

F-10

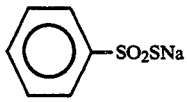

F-11

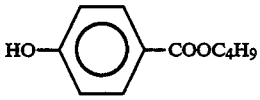

Samples 102 to 117

Samples 102 to 110 were prepared in the same manner as in the preparation of Sample 101, except that ExY-3 in the twelfth layer was replaced by the same molar amount of the comparative coupler or the coupler of the present invention as shown in Table 2 below.

Samples 111 to 117 were prepared in the same manner as in the preparation of Sample 101, except that ExY-3 in the twelfth layer was replaced by the coupler of the present invention as shown in Table 2 below, the amount of the coupler being so adjusted that the relative sensitivity of the sample was the same as that of Sample 101.

The thus prepared samples were imagewise exposed to white light and then subjected to color development in accordance with the process mentioned below. The yellow density of each of the processed samples was measured. The relative sensitivity of each sample to the sensitivity of Sample 101 which was taken as 0 (zero) was obtained, as a logarithmic number of the reciprocal of the amount of exposure which gives a density of (fog+0.3).

Each sample was exposed through a pattern for measurement of the graininess and then developed. The RMS graininess of the processed sample was obtained, as measured with a 48 μm-aperture meter. The results obtained are shown in Table 2.

TABLE 2

| Sample | Coupler in 12th Layer: Coupler | Coupler in 12th Layer: Amount (*1) | Relative Sensitivity | RMS Value (× 1000) (*2) |
|---|---|---|---|---|
| 101 (comparative sample) | ExY-3 | 1.0 | 0.00 | 33.5 |
| 102 (comparative sample) | RC-1 | 1.0 | −0.23 | 30.8 |
| 103 (comparative sample) | RC-2 | 1.0 | −0.12 | 31.1 |
| 104 (sample of the invention) | (1) | 1.0 | 0.07 | 33.7 |
| 105 (sample of the invention) | (2) | 1.0 | 0.07 | 33.7 |
| 106 (sample of the invention) | (4) | 1.0 | 0.07 | 33.9 |
| 107 (sample of the invention) | (8) | 1.0 | 0.07 | 33.8 |
| 108 (sample of the invention) | (9) | 1.0 | 0.06 | 33.9 |
| 109 (sample of the invention) | (14) | 1.0 | 0.04 | 34.5 |
| 110 (sample of the invention) | (16) | 1.0 | 0.04 | 34.4 |
| 111 (sample of the invention) | (1) | 0.65 | 0.01 | 30.2 |
| 112 (sample of the invention) | (2) | 0.65 | 0.00 | 30.2 |
| 113 (sample of the invention) | (4) | 0.70 | 0.01 | 30.5 |
| 114 (sample of the invention) | (8) | 0.70 | 0.00 | 30.3 |
| 115 (sample of the invention) | (9) | 0.75 | 0.00 | 30.9 |
| 116 (sample of the invention) | (14) | 0.85 | 0.00 | 32.2 |
| 117 (sample of the invention) | (16) | 0.85 | 0.00 | 32.0 |

(*1): Molar ratio to Sample 101
(*2): RMS graininess of yellow density (fog + 0.6)

From Table 2 above, it is understood that Samples 104 to 110 of the present invention which contained the same molar amount of the coupler in the twelfth layer as the comparative Samples 101 to 103 all had a higher sensitivity than the comparative samples. From the same table, it is also understood that Samples 111 to 117 of the present invention, which were prepared in the same manner as in the preparation of the comparative Sample 101 to have the same relative sensitivity as that of the comparative Sample 101 with respect to the twelfth layer, had a better graininess and a higher sensitivity than the comparative samples.

Color development of the samples was effected in accordance with the process mentioned below.

The amount of replenisher is per meter of 35 mm-wide sample.

Compositions of the processing solutions used above are mentioned below,

Color Developer:

| | Tank Solution | Replenisher |
|---|---|---|
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.7 g |
| Potassium Iodide | 1.5 mg | — |
| Hydroxylamine Sulfate | 2.4 g | 2.8 g |
| 4-[N-ethyl-N-β-hydroxyethylamino]-2-methylaniline Sulfate | 4.5 g | 5.5 g |
| Water to make | 1.0 liter | 1.0 liter |
| pH | 10.05 | 10.10 |

Bleaching Solution:

Tan solution and replenisher were the same.

| | |
|---|---|
| Ammonium Ferric Ethylenediaminetetraacetate Dihydrate | 120.0 g |
| Disodium Ethylenediaminetetraacetate | 10.0 g |
| Ammonium Bromide | 100.0 g |
| Ammonium Nitrate | 10.0 g |
| Bleaching Accelerator $(CH_3)_2N—CH_2—CH_2—S—S—CH_2—CH_2—N(CH_3)_2 \cdot 2HCl$ | 0.005 mol |
| Aqueous Ammonia (27%) | 15.0 ml |
| Water to make | 1.0 liter |
| pH | 6.3 |

Bleach-fixing Solution:

Tank

Color Development Process:

| Step | Time | Temperature | Amount of Replenisher | Tank Capacity |
|---|---|---|---|---|
| Color Development | 3 min 15 sec | 38° C. | 45 ml | 10 liters |
| Bleaching | 1 min 00 sec | 38° C. | 20 ml | 4 liters |
| Bleach-fixation | 3 min 15 sec | 38° C. | 30 ml | 8 liters |
| Rinsing (1) | 40 sec | 35° C. | (counter-current system from Rinsing (2) to Rinsing (1)) | 4 liters |
| Rinsing (2) | 1 min 00 sec | 35° C. | 30 ml | 4 liters |
| Stabilization | 40 sec | 35° C. | 20 ml | 4 liters |
| Drying | 1 min 15 sec | 55° C. | | |

-continued

| | Solution | Replenisher |
|---|---|---|
| Ammonium Ferric Ethylenediaminetetraacetate Dihydrate | 50.0 g | — |
| Disodium Ethylenediaminetetraacetate | 5.0 g | 2.0 g |
| Sodium Sulfite | 12.0 g | 20.0 g |
| Ammonium Thiosulfate Aqueous Solution (700 g/liter) | 240.0 ml | 400.0 ml |
| Aqueous Ammonia (27%) | 6.0 ml | — |
| Water to make | 1.0 liter | 1.0 liter |
| pH | 7.2 | 7.3 |

Rinsing Solution

Tank solution and replenisher were the same.

City water was passed through a mixed bed type column which was filled with an H-type strong acidic cation-exchange resin (Amberlite IR-120B, produced by Rohm & Haas Co.) and an OH-type strong basic anion-exchange resin (Amberlite IR-400, produced by Rohm & Haas Co.) so that both the calcium ion concentration and the magnesium ion concentration in the water were reduced to 3 mg/liter or less, individually. Next, 20 ml/liter of sodium dichloroisocyanurate and 150 mg/liter of sodium sulfate were added to the resulting water, which had a pH value falling within the range of from 6.5 to 7.5. This was used as the rinsing water.

Stabilizer

Tank solution and replenisher were the same.

-continued

| | |
|---|---|
| Sodium P-toluenesulfinate | 0.03 g |
| Polyoxyethylene-p-monononylphenyl Ether (mean polymerization degree 10) | 0.2 g |
| Disodium Ethylenediaminetetraacetate | 0.05 g |
| 1,2,4-Triazole | 1.3 g |
| 1,4-Bis(1,2,4-triazol-1-ylmethyl)-piperazine | 0.75 g |
| Water to make | 1.0 liter |
| pH | 8.5 |

EXAMPLE 2

Samples 201 to 209 were prepared in the same manner as in the preparation of Sample 101, except that ExY-1 in the 4th, 7th, 8th, 9th and 11th layers was replaced by the same molar amount of the comparative coupler or the coupler of the present invention as indicated in Table 3 below.

These samples were subjected to uniform blue-light exposure and then to green-light imagewise exposure, and subjected to color development in accordance with the process mentioned below. A value was obtained as a color turbidity, by subtracting the yellow density at the magenta fog density point from the yellow density at the magenta density of (fog+1.0).

These samples were subjected to imagewise exposure to white light and then subjected to color development in accordance with the process mentioned below. The processed samples were stored under the condition of 50° C. and 70% relative humidity (RH) for 63 days, or a fluorescent lamp of 20,000 lux was irradiated to the processed samples from the emulsion-coated surface for 7 days. For each of the stored or irradiated samples, the decrease of the yellow density at the point of having the initial yellow density of 2.5 was obtained. The smaller the value obtained, the smaller the decrease of the density.

The results obtained are shown in Table 3 below.

TABLE 3

| Sample | Coupler in 4th, 7th, 8th, 9th and 11th Layers | Color Turbidity | Decrease of Density after Stored under 50° C. and 70% RH for 63 days | Decrease of Density after Exposure to Fluorescent Lamp |
|---|---|---|---|---|
| 101 (comparative sample) | ExY-1 | −0.07 | 0.25 | 0.19 |
| 201 (comparative sample) | RC-3 | −0.06 | 0.21 | 0.12 |
| 202 (comparative sample) | RC-4 | −0.04 | 0.20 | 0.14 |
| 203 (sample of the invention) | (20) | −0.11 | 0.09 | 0.04 |
| 204 (sample of the invention) | (21) | −0.10 | 0.08 | 0.04 |
| 205 (sample of the invention) | (25) | −0.09 | 0.09 | 0.04 |
| 206 (sample of the invention) | (27) | −0.09 | 0.08 | 0.03 |
| 207 (sample of the invention) | (28) | −0.10 | 0.08 | 0.03 |
| 208 (sample of the invention) | (29) | −0.07 | 0.12 | 0.07 |
| 209 (sample of the invention) | (33) | −0.07 | 0.13 | 0.08 |

From Table 4 above, it is obvious that Samples 203 to 209 each containing the coupler of the present invention have better color reproducibility based on the measured color turbidity and have better storage stability with respect to the yellow image formed, than comparative Samples 101, 201 and 202 each containing the comparative coupler.

Color development of the samples was effected in accordance with the process mentioned below.

Color Development Process:

| Step | Time | Temperature | Amount of Replenisher | Tank Capacity |
|---|---|---|---|---|
| Color Development | 3 min 15 sec | 38° C. | 22 ml | 20 liters |
| Bleaching | 3 min 00 sec | 38° C. | 25 ml | 40 liters |
| Rinsing | 30 sec | 24° C. | 1200 ml | 20 liters |
| Fixation | 3 min 00 sec | 38° C. | 25 ml | 30 liters |
| Rinsing (1) | 30 sec | 24° C. | counter-current system from (2) to (1) | 10 liters |
| Rinsing (2) | 30 sec | 24° C. | 1200 ml | 10 liters |

-continued

Color Development Process:

| Step | Time | Temperature | Amount of Replenisher | Tank Capacity |
|---|---|---|---|---|
| Stabilization | 30 sec | 38° C. | 25 ml | 10 liters |
| Drying | 4 min 20 sec | 55° C. | | |

The amount of replenisher is per meter of 35 mm-wide sample.

Compositions of the processing solutions used above are mentioned below.

| Color Developer: | Tank Solution | Replenisher |
|---|---|---|
| Diethylenetriaminepenta-acetic Acid | 1.0 g | 1.1 g |
| 1-Hydroxyethylidene-1,1-di-phosphonic Acid | 3.0 g | 3.2 g |
| Sodium Sulfite | 4.0 g | 4.4 g |
| Potassium Carbonate | 30.0 g | 37.0 g |
| Potassium Bromide | 1.4 g | 0.3 g |
| Potassium Iodide | 1.5 mg | — |
| Hydroxylamine Sulfate | 2.4 g | 2.8 g |
| 4-[N-ethyl-N-β-hydroxyethyl-amino]-2-methylaniline Sulfate | 4.5 g | 6.2 g |
| Water to make | 1.0 liter | 1.0 liter |
| pH | 10.05 | 10.15 |
| **Bleaching Solution:** | | |
| Sodium Ferric Ethylenedi-aminetetraacetate Trihydrate | 100.0 g | 120.0 g |
| Disodium Ethylenediamine-tetraacetate | 10.0 g | 11.0 g |
| 3-Mercapto-1,2,4-triazole | 0.08 g | 0.09 g |
| Ammonium Bromide | 140.0 g | 160.0 g |
| Ammonium Nitrate | 30.0 g | 35.0 g |
| Aqueous Ammonia (27 %) | 6.5 ml | 4.0 ml |
| Water to make | 1.0 liter | 1.0 liter |
| pH | 6.0 | 5.7 |
| **Fixing Solution:** | | |
| Disodium Ethylenediamine-tetraacetate | 0.5 g | 0.7 g |
| Ammonium Sulfite | 20.0 g | 22.0 g |
| Ammonium Thiosulfate Aqueous Solution (700 g/liter) | 290.0 ml | 320.0 ml |
| Water to make | 1.0 liter | 1.0 liter |
| pH | 6.7 | 7.0 |
| **Stabilizer:** | | |
| Tank solution and replenisher were the same. | | |
| Sodium P-toluenesulfinate | 0.03 g | |
| Polyoxyethylene-p-monononylphenyl Ether" (mean polymerization degree 10) | 0.2 g | |
| Disodium Ethylenediaminetetraacetate | 0.05 g | |
| 1,2,4-Triazole | 1.3 g | |
| 1,4 Bis(1,2,4-triazol-1-ylmethyl)-piperazine | 0.75 g | |
| Water to make | 1.0 liter | |
| pH | 8.5 | |

Structural formulae of the comparative couplers used above are set forth below.

(RC-1) (Coupler described in French Patent 991,453)

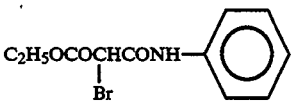

(RC-2) (Coupler described in U.S. Pat. No. 2,500,487)

-continued

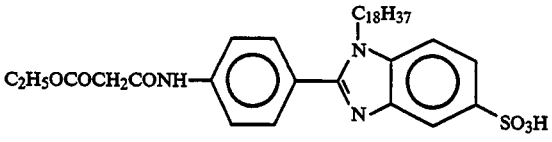

(RC-3) (Coupler described in JP-A-57-151944)

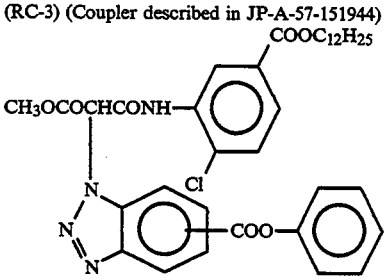

(RC-4) (Coupler described in JP-A-57-151944)

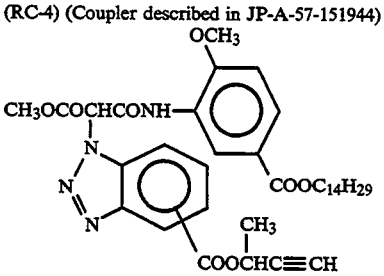

The silver halide color photographic material of the present invention contains a novel yellow coupler having a high dye-forming rate to give a dye having a high color density and a high color fastness. The material forms a photographic image having improved sharpness and color reproducibility and elevated sensitivity and color fastness.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material containing at least one coupler compound of the following general formula (1) in at least one hydrophilic colloid layer which is provided on a support:

$$R^1OCOCHXCONR^2R^3$$

where $R^1$ represents a branched substituted or unsubstituted alkyl group, a substituted or unsubstituted aryl group or a substituted or unsubstituted heterocyclic group; $R^2$ represents a hydrogen atom, a substituted or unsubstituted alkyl group, a substituted or unsubstituted aryl group or a substituted or unsubstituted heterocyclic group; $R^3$ represents a substituted or unsubstituted alkyl group, a substituted or unsubstituted aryl group or a substituted or unsubstituted heterocyclic group; X represents a group which splits off from the coupler compound when the coupler compound is reacted with an oxidation product of an aromatic primary amine developing agent; and $R^2$ and $R^3$ are the same or different, or may be bonded to each other to form a ring.

2. The silver halide color photographic material as claimed in claim 1, in which, in formula (1), $R^1$ represents a branched alkyl group or an aryl group, $R^2$ represents a hydrogen atom, $R^3$ represents an aryl group, and X represents a nitrogen-containing heterocyclic group.

3. The silver halide color photographic material as claimed in claim 1, in which the coupler of formula (1) is a non-diffusive coupler.

4. The silver halide color photographic material as claimed in claim 2, in which the coupler of formula (1) is a non-diffusive coupler.

5. The silver halide color photographic material as claimed in claim 1, wherein $R^1$ represents an α-branched alkyl group or an ortho-substituted phenyl group, $R^2$ represents a phenyl or naphthyl group, and X represents a a 5-membered cyclic imido group which is bonded to the coupler compound via the nitrogen atom of the group, a 1-pyrazolyl group, a 1-imidazolyl group, a 1,2,4-triazolyl group as bonded to the coupling position of the compound via 1- or 4-position of the group, a 1-benzotriazolyl group, or a 1,2,3-triazolyl group.

6. The silver halide color photographic material according to claim 5, wherein $R^2$ represents a phenyl group having a halogen atom or an alkoxy group at the orthoposition.

7. The silver halide color photographic material as claimed in claim 1, wherein the branched alkyl group is a cyclic alkyl group or a cyclic alkyl-substituted alkyl group.

8. The silver halide color photographic material as claimed in claim 1, wherein the branched alkyl group has from 3 to 30 carbon atoms.

9. The silver halide color photographic material as claimed in claim 1, wherein the branched alkyl group is selected from the group consisting of isopropyl, t-butyl, t-amyl, cyclohexyl, 2-ethylhexyl, sec-butyl, isobutyl, isoamyl, t-octyl, cyclohexyl, 4-t-butyl cyclohexyl, cyclohexylmethyl and neopentyl groups, which are substituted or unsubstituted.

10. The silver halide color photographic material as claimed in claim 1, wherein when $R^2$ and $R^3$ represent an alkyl group, the alkyl group has from 1 to 30 carbon atoms.

11. The silver halide color photographic material as claimed in claim 1, wherein the alkyl groups represented by $R^2$ and $R^3$ are selected from the group consisting of methyl, ethyl, propyl, isopropyl, isoamyl, 2-ethylhexyl, dodecyl and cyclohexyl groups, which are substituted or unsubstituted.

12. The silver halide color photographic material as claimed in claim 1, wherein when $R^1$, $R^2$ and $R^3$ represent an aryl group, the aryl group has from 6 to 20 carbon atoms.

13. The silver halide color photographic material as claimed in claim 1, wherein when $R^1$, $R^2$ and $R^3$ represent a heterocyclic group, the heterocyclic group is a 5-membered to 7-membered heterocyclic group having at least one hetero atom selected from the group consisting of nitrogen, oxygen and sulfur atoms and has from 1 to 10 carbon atoms.

14. The silver halide color photographic material as claimed in claim 1, wherein the heterocyclic groups represented by $R^1$, $R^2$ and $R^3$ are selected from group consisting of 2-furyl, 2-thienyl, 2-pyridyl, 2-imidazolyl, 2-(1,3-oxazolyl), 5-tetrazolyl, 1-piperidinyl, 5-indolinyl, 1,3,4-thiadiazolyl, benzoxaxol-2-yl, benzothiazol-2-yl, benzimidazol-2-yl, 1,2,4-triazol-5-yl, 3-pyrazolyl, 2-morpholyl, 4-morpholyl, 2-quinolyl and 2-quinazolyl groups, which may optionally be substituted.

15. The silver halide color photographic material as claimed in claim 1, wherein X is an aryloxy group, a heterocyclic-oxy group, an arylthio group, a heterocyclic-thio group, an imido group which is bonded to the coupling position of the coupler compound via the nitrogen atom, or an unsaturated nitrogen-containing heterocyclic group which is bonded to the coupling position of the coupler compound via the nitrogen atom of the group.

16. The silver halide color photographic material as claimed in claim 1, wherein when $R^1$, $R^2$, $R^3$ and X in formula (1) are substituted, the substituents are selected from the group consisting of a halogen atom, an alkoxycarbonyl group, an acylamino group, a sulfonamido group, a carbamoyl group, a sulfamoyl group, an alkoxy group, an aryloxy group, an aryloxycarbonyl group, an N-acylsulfamoyl group, a sulfonyl group, an alkoxycarbonylamino group, a cyano group, a nitro group, a carboxyl group, a hydroxyl group, a sulfo group, an alkylthio group, an ureido group, an aryl group, a heterocyclic group, an alkyl group, an acyl group, an arylthio group, a sulfamoylamino group and an N-sulfonylsulfamoyl group and said subsituents may further be substituted by one or more of said substituents.

17. The silver halide color photographic material as claimed in claim 1, wherein when $R^1$, $R^2$, $R^3$ and X in formula (1) are substituted, the substituents are selected from the group consisting of fluorine, chlorine, an alkoxycarbonyl group having from 2 to 30 carbon atoms, an acylamino group having from 2 to 30 carbon atoms, a sulfonamido group having from 1 to 30 carbon atoms, a carbamoyl group having from 1 to 30 carbon atoms, a sulfamoyl group having from 0 to 30 carbon atoms, an alkoxy group having from 1 to 30 carbon atoms, an aryloxy group having from 6 to 20 carbon atoms, an aryloxycarbonyl group having from 7 to 21 carbon atoms, an N-acylsulfamoyl group having from 2 to 30 carbon atoms, a sulfonyl group having from 1 to 30 carbon atoms, an alkoxycarbonylamino group having from 1 to 30 carbon atoms, a cyano group, a nitro group, a carboxyl group, a hydroxyl group, a sulfo group, an alkylthio group having from 1 to 30 carbon atoms, an ureido group having from 1 to 30 carbon atoms, an aryl group having from 6 to 20 carbon atoms, a 3-membered to 12-membered mono-cyclic ring or condensed ring having from 1 to 20 carbon atoms and having at least one nitrogen atom, oxygen atom or sulfur atom as a hetero atom, a linear, branched or cyclic and saturated or unsaturated alkyl group having from 1 to 30 carbon atoms, an acyl group having from 1 to 30 carbon atoms, an arylthio group having from 6 to 20 carbon atoms, a sulfamoylamino group having from 0 to 30 carbon atoms and an N-sulfonylsulfamoyl group having from 1 to 30 carbon atoms, and said substituents may further be substituted by one or more of said substituents.

18. The silver halide color photographic material as claimed in claim 1, wherein $R^1$ is a branched alkyl group or an aryl group.

19. The silver halide color photographic material as claimed in claim 1, wherein $R^2$ is a hydrogen atom.

20. The silver halide color photographic material as claimed in claim 1, wherein $R^3$ is an aryl group.

21. The silver halide color photographic material as claimed in claim 1, wherein X is a nitrogen-containing heterocyclic group.

22. The silver halide color photographic material as claimed in claim 1, wherein the total amount of the couplers of formula (1) which is incorporated into the photographic material is from 0.0001 to 0.80 g/m$^2$ if the split-off group X of the coupler molecule contains a photographically useful group.

23. The silver halide color photographic material as claimed in claim 1, wherein the total amount of the couplers of formula (1) which is incorporated into the photographic material is 0.001 to 1.20 g/m$^2$ if the split-off group X of the coupler molecule does not contain a photographically useful group.

24. The silver halide color photographic material as claimed in claim 1, wherein the hydrophilic colloid is a silver halide emulsion layer.

25. The silver halide color photographic material as claimed in claim 1, wherein the hydrophilic colloid is a light-insensitive layer.

* * * * *